US008387196B2

(12) United States Patent
Jimenez et al.

(10) Patent No.: US 8,387,196 B2
(45) Date of Patent: Mar. 5, 2013

(54) ORAL CARE IMPLEMENT HAVING A TURBINE-LIKE ARRANGEMENT OF CLEANING ELEMENTS

(75) Inventors: Eduardo Jimenez, Manalapan, NJ (US); Michael Rooney, Millburn, NJ (US); Robert Moskovich, East Brunswick, NJ (US); Armin Baertschi, Winznau (CH)

(73) Assignee: Colgate-Palmolive Company, New York, NY (US)

( * ) Notice: Subject to any disclaimer, the term of this patent is extended or adjusted under 35 U.S.C. 154(b) by 724 days.

(21) Appl. No.: 12/547,914

(22) Filed: Aug. 26, 2009

(65) Prior Publication Data

US 2011/0047734 A1 Mar. 3, 2011

(51) Int. Cl.
*A46B 9/02* (2006.01)

(52) U.S. Cl. ..... 15/110; 15/22.1; 15/207.2; 15/167.1

(58) Field of Classification Search ..... 15/167.1, 15/22.1, 207.2, 168, 110, 111
See application file for complete search history.

(56) References Cited

U.S. PATENT DOCUMENTS

| | | | |
|---|---|---|---|
| 3,605,154 | A | 9/1971 | Dawkins |
| 4,030,845 | A | 6/1977 | Deckert |
| 4,382,309 | A | 5/1983 | Collis |
| 5,173,983 | A | 12/1992 | Le |
| D390,706 | S | 2/1998 | Hohlbein et al. |
| 5,758,383 | A | 6/1998 | Hohlbein |
| D404,205 | S | 1/1999 | Hohlbein |
| D404,206 | S | 1/1999 | Hohlbein |
| 5,863,102 | A | 1/1999 | Waguespack et al. |
| 5,896,614 | A | 4/1999 | Flewitt |
| 5,903,951 | A | 5/1999 | Ionta et al. |
| 5,946,758 | A | 9/1999 | Hohlbein et al. |
| 5,991,958 | A | 11/1999 | Hohlbein |
| 6,041,468 | A | 3/2000 | Chen et al. |
| 6,073,299 | A | 6/2000 | Hohlbein |
| 6,088,870 | A | 7/2000 | Hohlbein |
| D429,887 | S | 8/2000 | Hohlbein et al. |
| 6,276,021 | B1 | 8/2001 | Hohlbein |
| D450,457 | S | 11/2001 | Hohlbein |
| 6,314,606 | B1 | 11/2001 | Hohlbein |
| D451,286 | S | 12/2001 | Hohlbein |
| D456,138 | S | 4/2002 | Hohlbein |
| D456,139 | S | 4/2002 | Hohlbein |
| D457,323 | S | 5/2002 | Hohlbein |

(Continued)

FOREIGN PATENT DOCUMENTS

| | | | |
|---|---|---|---|
| GB | 2 371 217 | | 7/2002 |
| JP | 2000000117 | A * | 1/2000 |

(Continued)

OTHER PUBLICATIONS

International Search Report, dated Mar. 3, 2011, relating to corresponding International Application No. PCT/US2010/046796.

*Primary Examiner* — Shay Karls

(57) ABSTRACT

An oral care implement having an turbine-like arrangement of cleaning elements. In one aspect, the invention is an oral care implement comprising a handle: a head connected to the handle, the head comprising a first surface, the first surface comprising an elliptical zone and a plurality of circumferentially spaced apart spirals spreading out from the elliptical zone; and for each spiral, an arcuate cleaning element wall extending outward from the first surface of the head along the spiral. In another aspect, the invention may be an apparatus for incorporation into an ansate oral care implement that utilizes the aforementioned arrangement of cleaning elements.

30 Claims, 19 Drawing Sheets

U.S. PATENT DOCUMENTS

| | | | | |
|---|---|---|---|---|
| 6,421,867 | B1 * | 7/2002 | Weihrauch | 15/28 |
| D461,313 | S | 8/2002 | Hohlbein | |
| 6,442,787 | B2 | 9/2002 | Hohlbein | |
| D464,133 | S | 10/2002 | Barnett et al. | |
| 6,463,619 | B2 | 10/2002 | Gavney, Jr. | |
| D474,608 | S | 5/2003 | Hohlbein | |
| 6,658,688 | B2 | 12/2003 | Gavney, Jr. | |
| D486,649 | S | 2/2004 | Sprosta et al. | |
| 6,820,299 | B2 | 11/2004 | Gavney, Jr. | |
| 6,820,300 | B2 | 11/2004 | Gavney, Jr. | |
| 6,859,969 | B2 | 3/2005 | Gavney, Jr. et al. | |
| D511,249 | S | 11/2005 | Hohlbein | |
| D513,882 | S | 1/2006 | Hohlbein et al. | |
| D514,320 | S | 2/2006 | Hohlbein | |
| D514,812 | S | 2/2006 | Hohlbein et al. | |
| 6,996,870 | B2 | 2/2006 | Hohlbein | |
| D516,819 | S | 3/2006 | Hohlbein | |
| D517,812 | S | 3/2006 | Hohlbein et al. | |
| D517,813 | S | 3/2006 | Hohlbein et al. | |
| 7,007,332 | B2 | 3/2006 | Hohlbein | |
| 7,020,928 | B2 | 4/2006 | Hohlbein | |
| D520,753 | S | 5/2006 | Hohlbein | |
| 7,047,591 | B2 | 5/2006 | Hohlbein | |
| 7,051,394 | B2 | 5/2006 | Gavney, Jr. | |
| 7,069,615 | B2 | 7/2006 | Gavney, Jr. | |
| 7,089,621 | B2 | 8/2006 | Hohlbein | |
| D527,528 | S | 9/2006 | Hohlbein | |
| D528,803 | S | 9/2006 | Hohlbein | |
| D532,202 | S | 11/2006 | Hohlbein | |
| D532,607 | S | 11/2006 | Hohlbein | |
| 7,140,058 | B2 | 11/2006 | Gatzemeyer et al. | |
| 7,143,462 | B2 | 12/2006 | Hohlbein | |
| 7,168,125 | B2 | 1/2007 | Hohlbein | |
| 7,182,542 | B2 | 2/2007 | Hohlbein | |
| 7,213,288 | B2 | 5/2007 | Hohlbein | |
| 7,219,384 | B2 | 5/2007 | Hohlbein | |
| 7,222,382 | B2 | 5/2007 | Choi et al. | |
| 7,273,327 | B2 | 9/2007 | Hohlbein et al. | |
| D557,504 | S | 12/2007 | Hohlbein | |
| D557,505 | S | 12/2007 | Hohlbein | |
| 7,322,067 | B2 | 1/2008 | Hohlbein | |
| D562,560 | S | 2/2008 | Hohlbein | |
| 7,331,731 | B2 | 2/2008 | Hohlbein et al. | |
| 7,363,675 | B2 | 4/2008 | Gavney, Jr. | |
| 7,386,909 | B2 | 6/2008 | Hohlbein | |
| 7,458,125 | B2 | 12/2008 | Hohlbein | |
| 7,472,448 | B2 | 1/2009 | Hohlbein et al. | |
| 7,478,959 | B2 | 1/2009 | Hohlbein | |
| 7,480,955 | B2 | 1/2009 | Hohlbein et al. | |
| D589,260 | S | 3/2009 | Hohlbein | |
| D598,199 | S | 8/2009 | Russell et al. | |
| D599,556 | S | 9/2009 | Russell et al. | |
| 7,594,293 | B2 | 9/2009 | Xi et al. | |
| 7,721,376 | B2 | 5/2010 | Hohlbein et al. | |
| 7,722,274 | B2 | 5/2010 | Hohlbein et al. | |
| 7,735,174 | B2 | 6/2010 | Hohlbein et al. | |
| 7,814,603 | B2 * | 10/2010 | Gavney, Jr. | 15/110 |
| 2001/0044981 | A1 | 11/2001 | Munk | |
| 2003/0033680 | A1 | 2/2003 | Davies et al. | |
| 2003/0099502 | A1 | 5/2003 | Lai | |
| 2005/0271531 | A1 | 12/2005 | Brown, Jr. et al. | |
| 2007/0174979 | A1 | 8/2007 | Fujita | |
| 2007/0256263 | A1 | 11/2007 | Kunath et al. | |

FOREIGN PATENT DOCUMENTS

| | | |
|---|---|---|
| WO | WO 2004/028235 | 4/2004 |
| WO | WO 2004/112538 | 12/2004 |

* cited by examiner

ORAL CARE IMPLEMENT HAVING A TURBINE-LIKE ARRANGEMENT OF CLEANING ELEMENTS

FIELD OF THE INVENTION

The present invention relates generally to ansate oral care implements, and specifically to toothbrushes, either manual or powered, that have a handle and a head having cleaning elements for oral cleaning.

BACKGROUND OF THE INVENTION

A toothbrush is used to clean the teeth by removing plaque and debris from the tooth surfaces. Conventional toothbrushes having a flat bristle trim are limited in their ability to conform to the curvature of the teeth, to penetrate into the interproximal areas between the teeth, to sweep away the plaque and debris, and to clean along the gum line. Additionally, such toothbrushes have a limited ability to retain dentifrice for cleaning the teeth. During the brushing process, the dentifrice typically slips through the tufts of bristles and away from the contact between the bristles and the teeth. As a result, the dentifrice is often spread around the mouth, rather than being concentrated on the contact of the bristles with the teeth. Therefore, the efficiency of the cleaning process is reduced.

While substantial efforts have been made to modify the cleaning elements of toothbrushes to improve the efficiency of the oral cleaning process and to hold the dentifrice in place during brushing, the industry continues to pursue arrangements of cleaning elements that will improve upon the preceding technology.

In early attempts to improve the cleaning elements of toothbrushes, oral care implements were developed having two or three circular brush sections arranged within holders that may be screwed into mating receptacles in the tooth brush handle so that they can be removed and replaced as needed. These brush section contain stiff cleaning elements and are spaced from one another along the longitudinal axis of the handle at a distance less than the thickness of a tooth so that the brush operates on both the lingual (inside) and facial (outside) surfaces of the teeth.

Also in existence are toothbrushes having a head containing a flexible, rubber-like prophylaxis polishing cup or "prophy cup" similar to that used by dental personnel to professionally clean teeth. This prophy cup is loaded with toothpaste by the user and applied to the teeth. The "soft rubber-like prophy cup device follows the contours of teeth more effectively than bristles." A ring of cleaning elements ("bristle tufts") are placed about the periphery of this toothbrush head which co-act with the prophy cups to clean the user's teeth and gums.

More recently, the strategic arrangement and combination of cleaning elements in the form of elastomeric prophy cups and bristle tufts has become a more common way of improving cleaning efficiency and maintaining the dentifrice in place during brushing. One example of the combined use and strategic arrangement of elastomeric prophy cups and bristle tufts can be found in an existing toothbrush having a head portion comprising a plurality of inner loops formed by elastomeric walls. The central inner loop is surrounded by an outer loop formed of bristles. Central cleaning elements, formed as bristle tufts, are located within the elastomeric inner loops.

Another example of the combined use and strategic arrangement of elastomeric prophy cups and bristle tufts can be found in an existing toothbrush having a head portion comprising a plurality of soft elastomer prophy cups surrounded by bristle rings. A toothbrush is also in existence wherein the centralized prophy cups are formed by groups of densely packed cleaning elements that are surrounded by bristle rings. The bristle rings in this toothbrush have one or more tufts at an inclination.

SUMMARY OF THE INVENTION

In one aspect, the invention can be an oral care implement comprising: a handle: a head connected to the handle, the head comprising a first surface, the first surface comprising an elliptical zone and a plurality of circumferentially spaced apart spirals spreading out from the elliptical zone; and for each spiral, an arcuate cleaning element wall extending outward from the first surface of the head along the spiral.

In another aspect, the invention can be an oral care implement comprising: a handle; a head connected to the handle, the head comprising a first surface having an array of spirals spreading out from a central zone; and for each spiral, an arcuate cleaning element wall extending outward from the first surface of the head along the spiral.

In yet another aspect, the invention can be an oral care implement comprising: a handle: a head connected to the handle, the head comprising a first surface having a first whirl of spirals spreading out from a central zone; and for each spiral in the first whirl, an arcuate cleaning element wall extending outward from the first surface of the head along the spiral.

In still another aspect, the invention can be an oral care implement comprising: a handle; a head connected to the handle, the head comprising a first surface having a central zone; a first array of arcuate cleaning element walls extending from the first surface, each of the arcuate cleaning element walls in the first array comprising a convex peripheral surface and a concave peripheral surface; and the first array of arcuate cleaning element walls arranged so as to circumferentially surround the central zone in a spaced-apart manner and oriented so that the convex peripheral surface of each cleaning element wall in the first array opposes the concave peripheral wall of an adjacent cleaning element wall in the first array.

In a further aspect, the invention can be an oral care implement comprising: a handle: a head connected to the handle, the head comprising a first surface having a central zone; an array of cleaning element walls extending from the first surface, each of the cleaning element walls in the first array comprising a length and a width, wherein the length is greater than the width; and the first array of cleaning element walls arranged so as to circumferentially surround the central zone in a spaced-apart manner and oriented so that the lengths of the cleaning element walls extend radially outward from the central region.

In a yet further aspect, the invention can be an apparatus for incorporation into an ansate oral care implement comprising: a base having a first surface: the first surface comprising an elliptical zone and a plurality of circumferentially spaced apart spirals spreading out from the elliptical zone; and for each spiral, an arcuate cleaning element wall extending outward from the first surface of the head along the spiral.

In a still further aspect, the invention can be an apparatus for incorporation into an ansate oral care implement comprising: a base having a first surface having an array of spirals spreading out from a central zone; and for each spiral, an arcuate cleaning element wall extending outward from the first surface of the head along the spiral.

In another aspect, the invention can be an apparatus for incorporation into an ansate oral care implement comprising:

a base having a first surface having a first whirl of spirals spreading out from a central zone; and for each spiral in the first whirl, an arcuate cleaning element wall extending outward from the first surface of the head along the spiral.

In an even further aspect, the invention can be an apparatus for incorporation into an ansate oral care implement comprising: a base having a first surface having a central zone: a first array of arcuate cleaning element walls extending from the first surface, each of the arcuate cleaning element walls in the first array comprising a convex peripheral surface and a concave peripheral surface: and the first array of arcuate cleaning element walls arranged so as to circumferentially surround the central zone in a spaced-apart manner and oriented so that the convex peripheral surface of each cleaning element wall in the first array opposes the concave peripheral wall of an adjacent cleaning element wall in the first array.

In a still further aspect, the invention can be an apparatus for incorporation into an ansate oral care implement comprising: a base having a first surface having a central zone: an array of cleaning element walls extending from the first surface, each of the cleaning element walls in the first array comprising a length and a width, wherein the length is greater than the width; and the first array of cleaning element walls arranged so as to circumferentially surround the central zone in a spaced-apart manner and oriented so that the lengths of the cleaning element walls extend radially outward from the central region.

In one more aspect, the invention can be an apparatus for an ansate oral implement comprising: a ring-like wall having an outer surface and an inner surface forming a cavity about a central axis; and an array of arcuate cleaning element walls extending radially outward from the outer surface of the ring-like wall, the array of arcuate cleaning elements being located about the circumference of the ring-like wall in a spaced-apart manner.

In another aspect, the invention is an apparatus for an ansate oral implement comprising: an elastomeric ring-like wall having an outer surface and an inner surface forming a cavity about a central axis; and an array of elastomeric cleaning element walls extending radially outward from the outer surface of the ring-like wall, the array of elastomeric cleaning elements being located about the circumference of the elastomeric ring-like wall in a spaced-apart manner.

In a further aspect, the invention is an oral care implement comprising: a handle; a head connected to the handle, the head comprising a first surface, the first surface comprising a central zone and a plurality of circumferentially spaced apart spirals spreading out from the elliptical zone; and for each spiral, an elongated cleaning element wall extending outward from the first surface of the head along the spiral.

BRIEF DESCRIPTION OF THE DRAWINGS

This invention is capable of use in a broad array of oral care implements and hygiene products. The drawings illustrate one use of the invention and are not to be construed as the only embodiment of the invention.

DETAILED DESCRIPTION OF THE DRAWINGS

In the following description, the invention is discussed in terms of a manual toothbrush incorporating the inventive arrangement of cleaning elements. However, in other forms, the invention could be in the form of other oral care implements including a soft-tissue cleansing implement, a powered toothbrush, or other ansate implements designed for oral care. Additionally, the invention can take the form of disc-like plates that incorporate the inventive arrangement of cleaning element walls for operable cooperation with a manual or powered oral care implement, such as a toothbrush or soft-tissue cleansing implement.

Referring first to FIGS. 1-4 concurrently, a toothbrush 100 is illustrated according to one embodiment of the present invention. The toothbrush 100 generally comprises a handle 110 and a head 120. The handle 110 provides the user with a mechanism by which he/she can readily grip and manipulate the toothbrush 100. The handle 110 is generically illustrated and may be formed of many different shapes, sizes, materials and a variety of manufacturing methods that are well-known to those skilled in the art. If desired, the handle 110 may include a suitable textured grip (not shown) made of elastomeric material or can be a multi-part construction. Stated simply, the details of the handle 110 are not limiting of the present invention and, thus, require no further discussion for purposes of the present invention.

Figure 1:
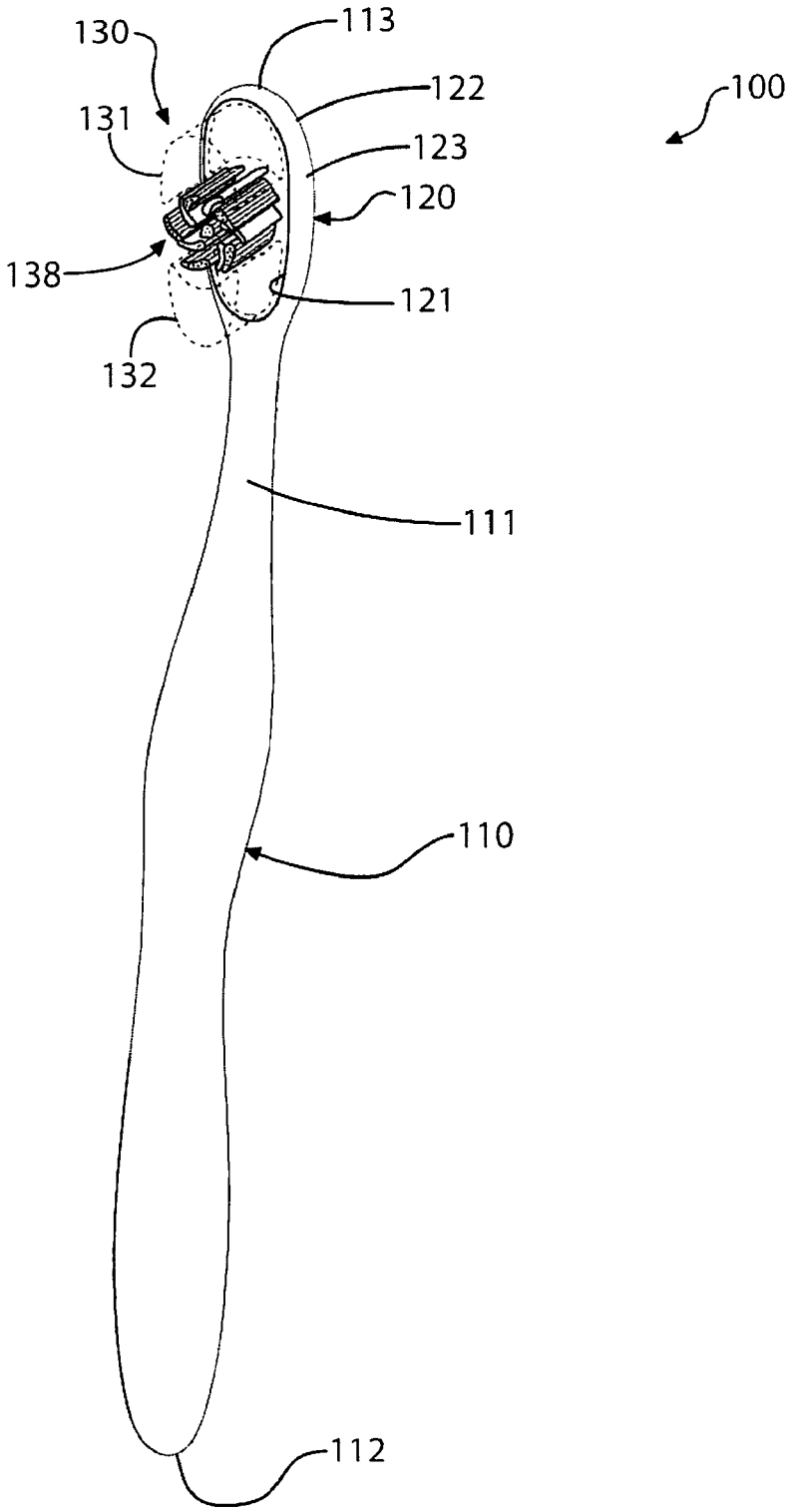
FIG. 1 is a perspective view of an ansate oral care implement, in the form of a manual toothbrush, according to one embodiment of the present invention.
Figure 2:
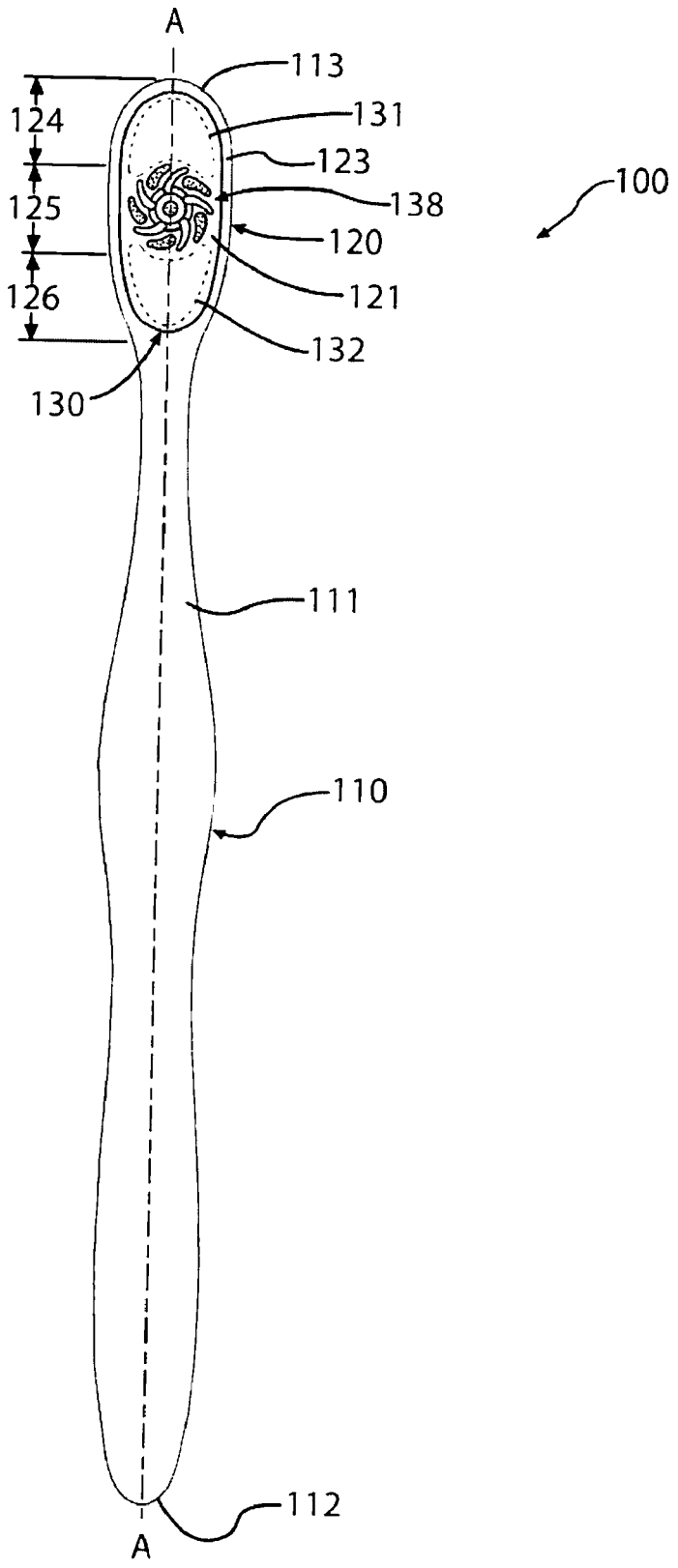
FIG. 2 is a front view of the toothbrush of FIG. 1.
Figure 3:
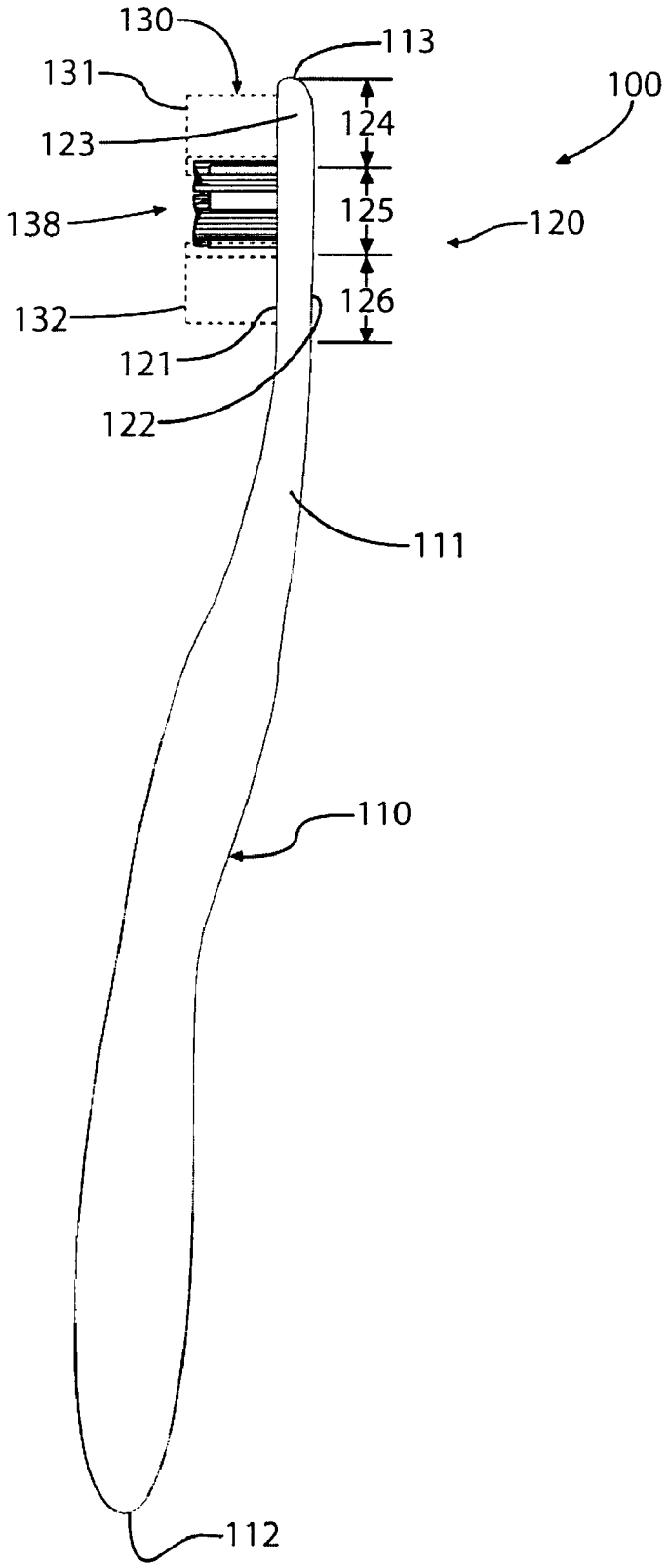
FIG. 3 is a right-side view the toothbrush of FIG. 1, the left-side view of which is a mirror image.

The toothbrush 100 extends from a proximal end 112 to a distal end 113 along a longitudinal axis A-A (illustrated in FIG. 2). The head 120 is operably connected to a distal end of the handle 110. The head 110 and handle 120 of the toothbrush are preferably formed as a single unitary structure using a molding, milling, machining or other suitable process. However, in other embodiments, the handle 110 and head 120 may be formed as separate components which are operably connected at a later stage of the manufacturing process by any suitable technique known in the art, including without limitation thermal welding, a tight-fit assembly, a coupling sleeve, adhesion, or fasteners. Whether the head 120 and handle 110 are of a unitary or multi-piece construction (including connection techniques) is not limiting of the present invention.

It should be noted at this time that relative terms such as distal, middle, proximal, upper, lower, top, bottom, left, right etc. are merely used to delineate relative positions of the components of the toothbrush 100 with respect to one another and are not intended to be in any further way limiting of the present invention.

The head 120 generally comprises a front surface 121, a rear surface 122 and a peripheral surface 123. The front surface 121 and the rear surface 122 of the head 120 can take on a wide variety of shapes and contours, none of which are limiting of the present invention. For example, the front and rear surfaces 121, 122 can be planar, contoured or combinations thereof. Moreover, if desired, the rear surface 122 may also comprise additional structures for oral cleaning, such as a soft tissue cleanser. An example of a suitable soft tissue cleanser is disclosed in U.S. Pat. No. 7,143,462, issued Dec. 5, 2006 to the assignee of the present application, the entirety of which is hereby incorporated by reference. Furthermore, while the head 120 is normally widened relative to the neck 111 of the handle 110, it could in some constructions simply be a continuous extension or narrowing of the handle 110.

The front surface 121 comprises a collection of cleaning elements 130 extending therefrom for cleaning contact with an oral surface. While the collection of cleaning elements 130 is particularly suited for brushing teeth, the collection of cleaning elements 130 can also be used to clean oral soft tissue, such as a tongue, gums, or cheeks instead of or in addition to teeth. As used herein, the term "cleaning element" is used in a generic sense to refer to any structure that can be used to clean or massage an oral surface through relative surface contact. Common examples of "cleaning elements" include, without limitation, bristle tufts, filament bristles, fiber bristles, nylon bristles, spiral bristles, rubber bristles, elastomeric protrusions, flexible polymer protrusions, co-extruded filaments, flag bristles, crimped bristles, anti-bacterial bristles, and combinations thereof and/or structures containing such materials or combinations.

The cleaning elements of the present invention can be connected to the head 120 in any manner known in the art. For example, anchor free tufting (AFT) could be used to mount the cleaning elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block. Of course, traditional staple anchoring technology can also be used.

Generally, the collection of cleaning elements 130 comprises a first set 131 of cleaning elements, a second set 132 of cleaning elements and a third set 138 of cleaning elements. Conceptually, the head 120 comprises a distal region 124, a middle region 125 and a proximal region 126. The first set 131 of cleaning elements extend from the distal region 124 of the head 120. The second set 132 of cleaning elements extend from the proximal region 126 of the head 120. The third set 138 of cleaning elements extend from the middle region 125 of the head.

The first and second sets 130, 131 of cleaning elements are generically illustrated in the toothbrush 100 because the exact arrangement and number of the cleaning elements of the first and second sets are not of particular concern in certain embodiments of the invention. The details of the cleaning elements within the first and second sets 130, 131 should not be considered as a limitation of the present invention unless specifically recited in the claims. In fact, in certain embodiments of the present invention, the first and second sets 130, 131 of the cleaning elements may be omitted all together or substantially altered. Nonetheless, a particularly useful and effective of arrangement of the first and second sets 130, 131 of the cleaning elements has been developed (discussed below in relation to FIGS. 17-18) and is to be considered as part of the invention in certain embodiments.

The third set 138 of cleaning elements generally comprises a first array of arcuate cleaning element walls 133*a-e* and a second array of arcuate cleaning element walls 134*a-e*. As will be described in greater detail, the first array of arcuate cleaning element walls 133*a-e* and the second array of arcuate cleaning element walls 134*a-e* are strategically located and oriented on the head 120 so as to form the appearance of two whirls of spirals extending from a central zone. Thought of another way, the geometric configuration resembles a turbine having two sets of blades. As used herein the term "central zone" does not refer to the zone's relative position on the head 120 but to the fact that the zone is circumferentially surrounded by the array(s) of cleaning element walls. Moreover, the term "central zone," in certain instances, includes a mere reference point on the head and is not limited to a reference area.

Figure 4:
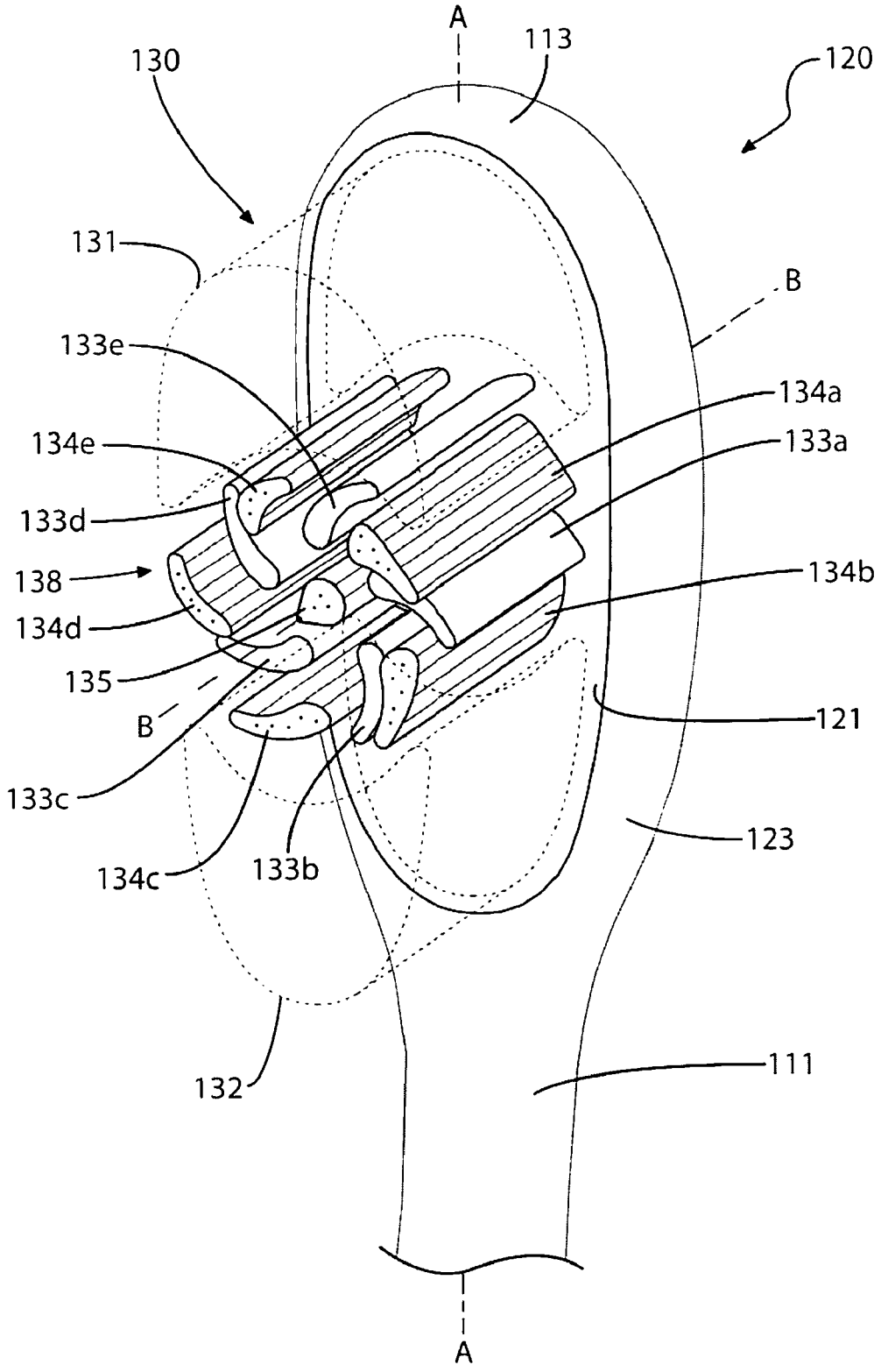
FIG. 4 is a close-up perspective view of the head of the toothbrush of FIG. 1.
Figure 5A:
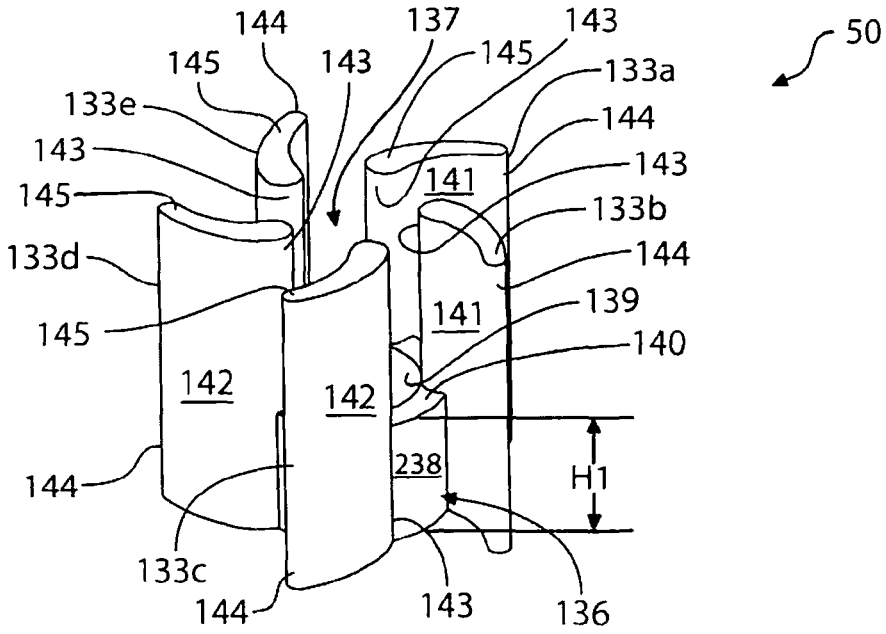
FIG. 5A is a perspective view of the elastomeric turbine ring of the toothbrush of FIG. 1 according to one embodiment of the present invention.
Figure 5B:
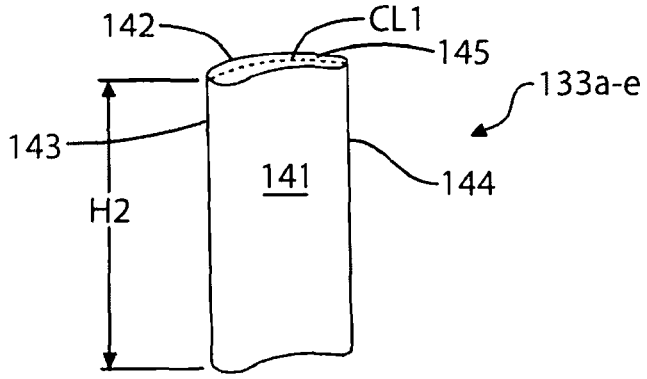
FIG. 5B is a perspective view of one of the arcuate cleaning element walls of the first array removed from the toothbrush of FIG. 1
Figure 5C:
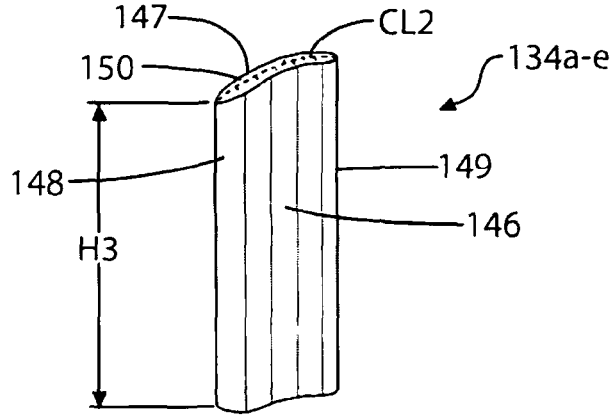
FIG. 5C is a perspective view of one of the arcuate cleaning element walls of the second array removed from the toothbrush of FIG. 1.
Figure 6:
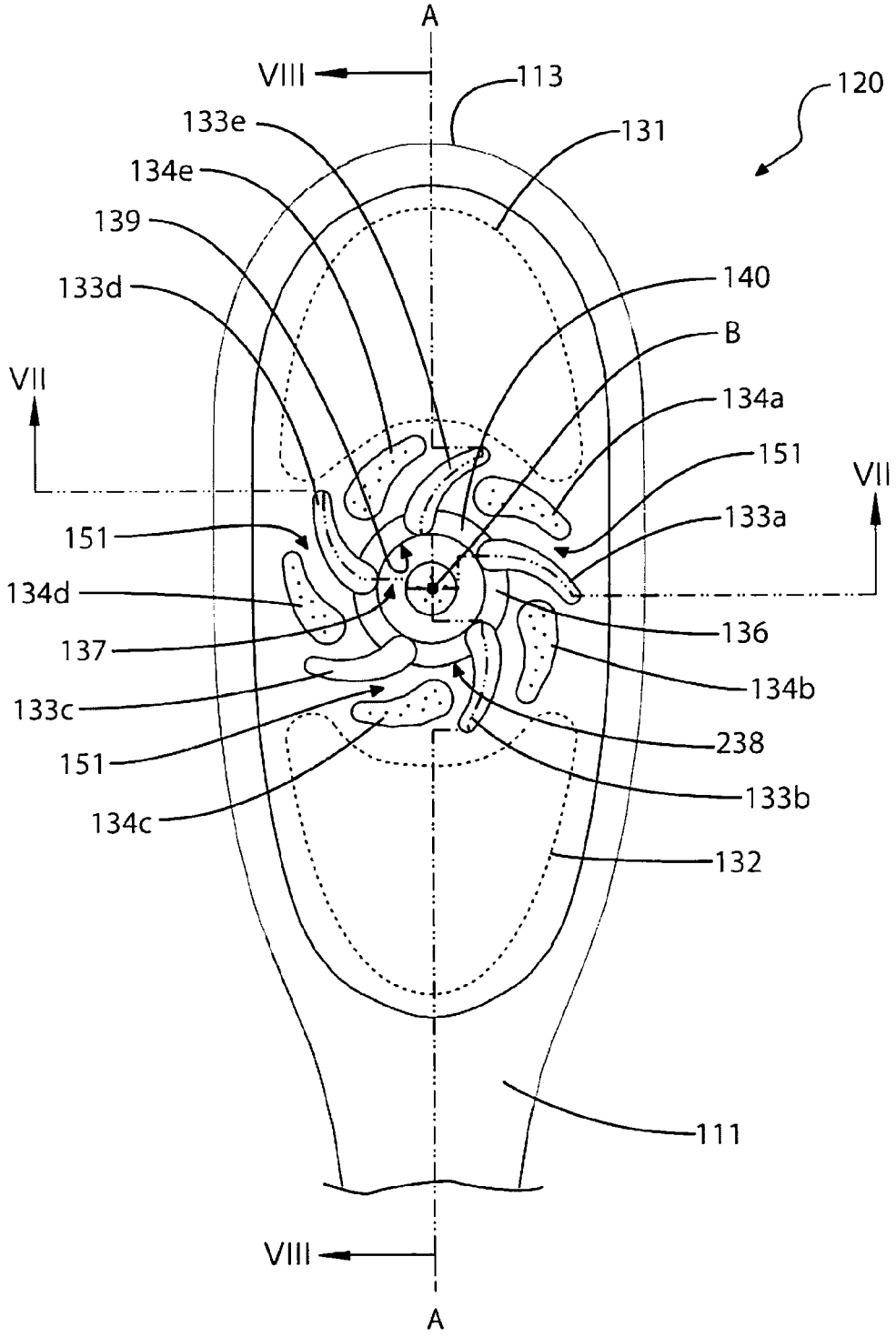
FIG. 6 is a front view of the head of the toothbrush of FIG. 1.
Figure 7:
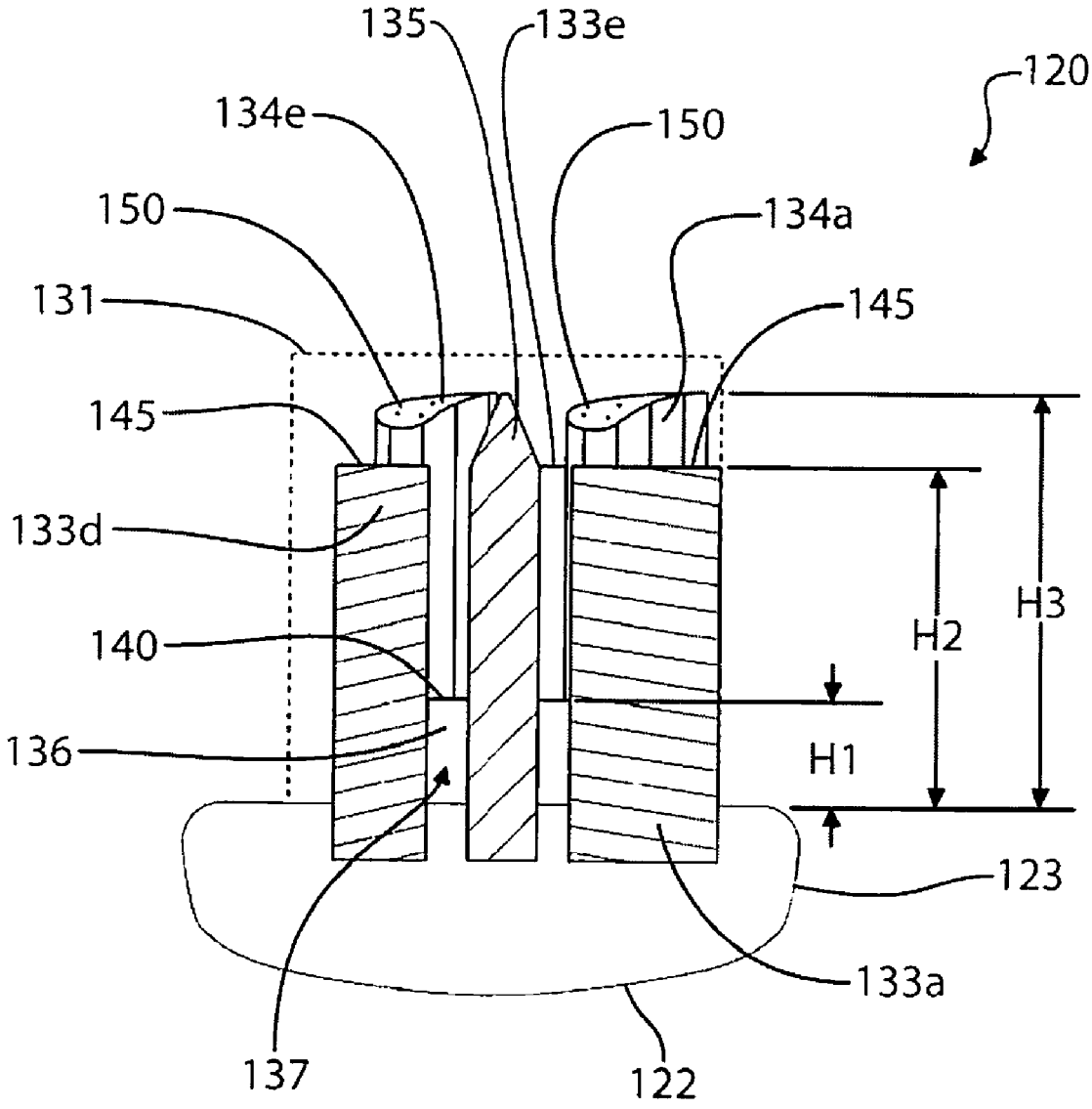
FIG. 7 is a cross-sectional view of the head of the toothbrush of FIG. 1 along view VII-VII of FIG. 6.
Figure 8:
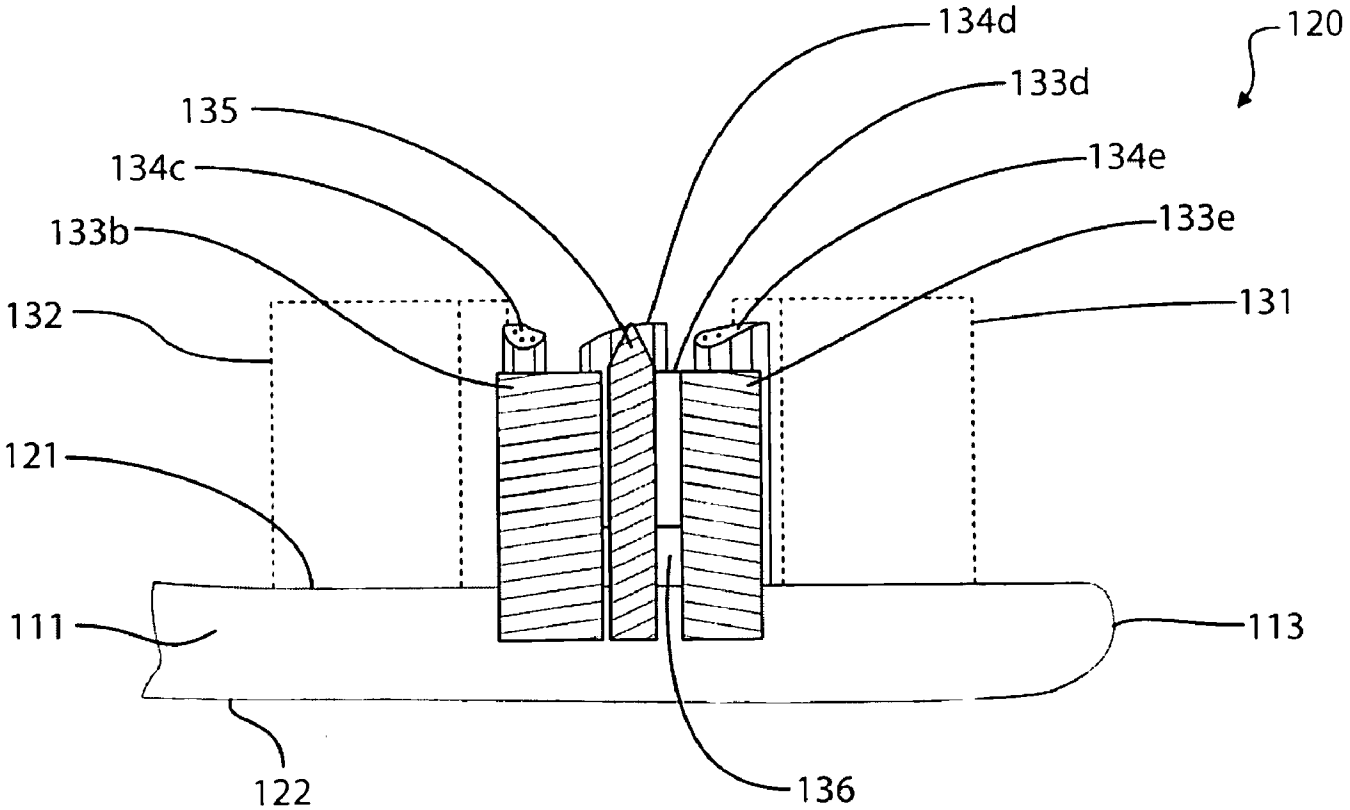
FIG. 8 is a cross-sectional view of the head of the toothbrush of FIG. 1 along view VIII-VIII of FIG. 6.

Referring now to FIGS. 4 and 6 concurrently, the details of the inventive arrangement and orientation of the third set 138 of cleaning elements on the head 120 of the toothbrush 100 will now be discussed according to one embodiment of the present invention. The arrangement of cleaning elements in the third set 138 is specifically designed to improve the efficacy of cleaning and polishing oral surfaces, retaining dentifrice on the head 120 of the toothbrush during brushing and/or massaging, and distributing the dentifrice on the head 120.

It should be understood that the concepts and arrangements of particular subsets of the cleaning elements will be described below in relation to their location about certain geometrical shapes, axes, and hypothetical regions or zones. It is to be understood, however, that such geometrical shapes, axes, and hypothetical regions or zones may not be physically delineated on the head 120 with any structure, barrier or interface but is merely used to describe the relative location and orientation of certain elements.

As mentioned above, the third set 138 of cleaning elements generally comprises a first array of arcuate cleaning element walls 133*a-e* and a second array of arcuate cleaning element walls 134*a-e*. The first array of arcuate cleaning element walls 133*a-e* are preferably constructed of an elastomeric material while the second array of arcuate cleaning element walls 134*a-e* are preferably constructed of densely packed bristles. Suitable elastomeric materials include any biocompatible resilient material suitable for uses in an oral hygiene apparatus. To provide optimum comfort as well as cleaning benefits, the elastomeric material preferably has a hardness property in the range of A8 to A25 Shore hardness. One preferred elastomeric material is styrene-ethylene/butylene-styrene block copolymer (SEBS) manufactured by GLS Corporation. Nevertheless, SEBS material from other manufacturers or other materials within and outside the noted hardness range could be used. Of course, the materials of construction for the first array of arcuate cleaning element walls 133*a-e* and the second array of arcuate cleaning element walls 134*a-e* can be respectively alternated in another embodiment. In still other embodiments, both the first array of arcuate cleaning element walls 133*a-e* and the second array of arcuate cleaning element walls 134*a-e* can be constructed of the same material, whether it is elastomeric, bristles or combinations thereof.

The first and second arrays of arcuate cleaning element walls 133*a-e,* 134*a-e* circumferentially surround an elongated central cleaning element 135 in an alternating arrangement. The elongated central cleaning element 135 is preferably a tuft of densely packed fibrous bristles but can also be an elastomer finger or other material or structure. Of course, the central cleaning element 135 may be omitted in certain embodiments of the invention.

The elongated central cleaning element 135 preferably extends outward from the front surface 121 of the head 120 at a substantially normal orientation along an axis B-B. Similarly, the individual cleaning element walls 133*a-e,* 134*a-e* of both the first and second arrays also extend outward from the front surface 121 of the head 120 at a substantially normal orientation. Of course, in alternative embodiments, one or more of the aforementioned cleaning elements 133*a-e,* 134*a-e,* 135 may be angled with respect to the front surface 121.

Referring now to FIGS. 5A, 5B and 6-8 concurrently, the structural details of the first array of cleaning element walls 133*a-e* will be described. The first array of cleaning element walls 133*a-e* are integrally formed with and extend radially outward from a ring wall 136 in a curved manner. Collectively, the first array of cleaning element walls 133*a-e* and the ring wall 136 form a turbine-like apparatus 50.

The ring wall 136 forms a substantially closed loop that circumferentially surrounds the axis B-B. The ring wall 136 is preferably an elastomeric material as discussed above and also extends outward from the front surface 121 of the head 120 at a substantially normal orientation. The ring wall 136 has a circular shape in the illustrated embodiment but can take on other shapes, such as other ellipses or polygons that form a substantially closed loop.

The ring wall 136 forms, along with the first array of cleaning element walls 133*a-e,* for a central cavity 137 (the elongated central cleaning element 135 is located within and extends outward so as to protrude from the cavity 137). The ring wall 136 has a convex outer peripheral surface 238, a concave inner peripheral surface 139 and a top surface 140. The top surface 140 of the ring wall 136 can be flat, tapered or contoured. The ring wall has a height H1 (measured from the first surface 121 of the head to the top surface 140. In one embodiment, the height $H_1$ is preferably in the range of 1 to 7 millimeters, and most preferably is 5 millimeters.

Figure 9:
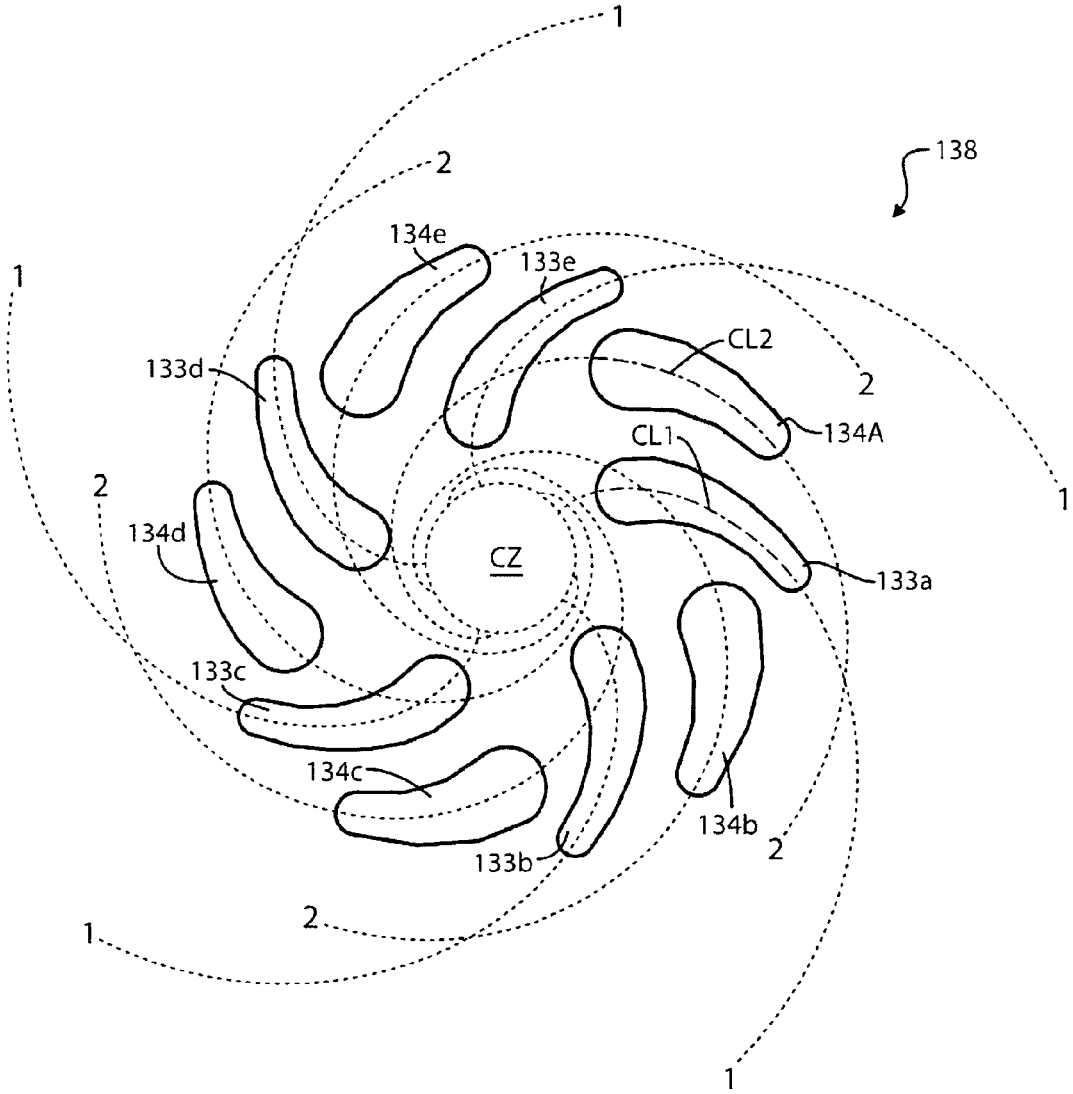
FIG. 9 is a schematic illustrating the geometric arrangement of the arcuate cleaning element walls of the toothbrush of FIG. 1.

The arcuate cleaning element walls 133*a-e* are arranged about the ring wall 136 in a circumferentially spaced-apart manner so as to be circumferentially equidistant from one another about the ring wall 136. While five arcuate cleaning element walls 133*a-e* are illustrated, less or more can be used as desired. All of the arcuate cleaning element walls 133*a-e* are also radially equidistant from the axis B-B. As will be described in detail below with respect to FIG. 9, each of the arcuate cleaning element walls 133*a-e* are spatially arranged about the ring wall 136 and have a curvature so as to extend outward from the first surface 121 of the head 120 along a spiral extending from a central zone CZ. As can be seen in FIG. 9, the arcuate cleaning element walls 133*a-e* extend along the spirals coextensively. The ring wall 136 provides structural support and integrity to the arcuate cleaning element walls 133*a-e* during oral care without interfering with the oral surface cleaning.

The arcuate cleaning element walls 133*a-e* have a concave peripheral surface 141, a convex peripheral surface 142, a first peripheral end surface 143 and a second peripheral end surface 144, which together define the horizontal cross-section of the arcuate cleaning element walls 133*a-e*. The arcuate cleaning element walls 133*a-e* terminate in a top surface 145. The top surface 145 can be flat, tapered, contoured or combinations thereof. Additionally, the top surface 145 may be smooth or roughened. The concave peripheral surface 141 and the convex peripheral surface 142 are arranged so as to gradually converge as one moves radially outward along the arcuate cleaning element walls 133*a-e*. As a result, the arcuate cleaning element walls 133*a-e* are wider at the first peripheral end surface 143 than at the second peripheral end surface 144.

The arcuate cleaning element walls 133*a-e* preferably extend outward from the first surface 121 of the head 120 so that the concave peripheral surface 141 and the convex peripheral surface 142 are substantially normal to the first surface 121 of the head 120. Of course, one or both of these surfaces 141, 142 may be inclined with respect to the front surface 121 if desired. The arcuate cleaning element walls 133*a-e* have a length L1 measured along their centerline CL1. The length L1 of arcuate cleaning element walls 133*a-e* is greater than the (mean) width of the arcuate cleaning element walls 134*a-e,* preferably by a ratio of at least 2:1.

The arcuate cleaning element walls 133*a-e* have a height H2 (measured from the first surface 121 of the head to the top surface 145. The height H2 is preferably greater than the height H1. In one embodiment, the height H2 is preferably in the range of 8 to 12 millimeters, and most preferably 10 millimeters.

While the ring wall 136 and the arcuate cleaning element walls 133*a-e* are integrally formed as a single unitary structure through a molding or other technique, it is possible for the ring wall 136 and the arcuate cleaning element walls 133*a-e* to be separately formed and/or be non-unitary structures. In other embodiments, the ring wall 136 may be omitted and the arcuate cleaning element walls 133*a-e* may stand independently in the desired arrangement and orientation.

Referring now to FIGS. 5C and 6-8 concurrently, the structural details of the second array of cleaning element walls 134*a-e* will be described. Each of cleaning element walls 134*a-e* of the second array are preferably formed by a wall of densely packed fibrous bristles. The cleaning element walls 134*a-e* of the second array extend radially outward from and circumferentially surround the axis B-B in a spaced apart manner. The cleaning element walls 134*a-e* of the second array preferably extend outward from the front surface 121 of the head 120 at a substantially normal orientation.

The arcuate cleaning element walls 134*a-e* are arranged in a circumferentially spaced-apart manner so as to be circumferentially equidistant from one another about the axis B-B. While five arcuate cleaning element walls 134*a-e* are illustrated, less or more can be used as desired. All of the arcuate cleaning element walls 134*a-e* are also radially equidistant from the axis B-B. As will be described in detail below with respect to FIG. 9, each of the arcuate cleaning element walls 134*a-e* are also spatially arranged on the head 120 so as to extend outward from the first surface 121 along a spiral extending from a central zone CZ. As can be seen in FIG. 9, the arcuate cleaning element walls 134*a-e* also extend in coextensively with the spirals.

The arcuate cleaning element walls 134*a-e* have a concave peripheral surface 146, a convex peripheral surface 147, a first peripheral end surface 148 and a second peripheral end surface 149, which together define the horizontal cross-section of the arcuate cleaning element walls 134*a-e*. The arcuate cleaning element walls 134*a-e* terminate in a top surface 150. The top surface 150 can be flat, tapered, staggered, contoured or combinations thereof. Preferably, the top surface is angled with respect to the front surface 121. The concave peripheral surface 146 and the convex peripheral surface 147 are arranged so as to gradually converge as one moves radially outward along the arcuate cleaning element walls 134*a-e*. As a result, the arcuate cleaning element walls 134*a-e* are wider at the first peripheral end surface 148 than at the second peripheral end surface 149.

The arcuate cleaning element walls 134*a-e* preferably extend outward from the first surface 121 of the head 120 so that the concave peripheral surface 146 and the convex peripheral surface 147 are substantially normal to the first surface 121 of the head 120. The arcuate cleaning element walls 134*a-e* have a length L2 measured along their centerline CL2. The length L2 of arcuate cleaning element walls 134*a-e* is greater than the (mean) width of the arcuate cleaning element walls 134*a-e*, preferably by a ratio of at least 2:1.

The arcuate cleaning element walls 134*a-e* have a height H3 (measured from the first surface 121 of the head 120 to the top surface 150. The height H3 is preferably greater than the height H2. In one embodiment, the height H3 is preferably in the range of 10 to 14 millimeters, and most preferably is 12 millimeters.

Referring now to FIG. 9, the geometric arrangement of the first and second arrays of arcuate cleaning element walls 133*a-e*, 134*a-e* will be described. As a point of reference, a hypothetical central zone CZ is selected at a desired position on the front surface 121 of the head 120. The central zone CZ is preferably elliptical but can take on any shape or can be a point. Hypothetically, extending from the central zone CZ is a first array of spirals 1 and a second array of spirals 2. While the spirals 1, 2 are illustrated as involute spirals, other spirals could be used. Furthermore, while both arrays of spirals 1, 2 are clockwise spirals, one or the other, or both arrays, can be counter-clockwise spirals (as illustrated in the embodiments of FIGS. 12-15).

The spirals 1 of the first array are circumferentially spaced-apart from one another about the perimeter of the central zone CZ. More specifically, the starting points of the spirals 1 of the first array are circumferentially spaced-apart from one another about the central zone CZ in an equidistant manner. The spirals 1 of the first array extend outward therefrom according to the desired spiral geometric equation. As can be seen, the spirals 1 of the first array are identical to one another in their defining geometric characteristics, including arc length, curvature, and tangential angle.

Similarly, the spirals 2 of the second array are also circumferentially spaced-apart from one another about the central zone CZ. The starting points of the spirals 2 of the second array are also circumferentially spaced-apart from one another about the perimeter of the central zone CZ in an equidistant manner. The spirals 2 of the second array extend outward therefrom according to the desired spiral geometric equations. As can be seen, the spirals 2 of the second array are identical to one another in their defining geometric characteristics, including arc length, curvature, and tangential angle. However, the spirals 2 of the second array have different defining geometric characteristics than that of the spirals 1 of the first array in the illustrated embodiment.

It is the spirals 1, 2 of the first and second arrays that provide the "roadmap" for the positioning and orientation of the arcuate cleaning element walls 133*a-e*, 134*a-e* on the head 120. Specifically, each one of the arcuate cleaning element walls 133*a-e* extend along one of the spirals 1 of the first array while each one of the arcuate cleaning element walls 134*a-e* extend along one of the spirals 1 of the first array. Most preferably, the arcuate cleaning element walls 133*a-e* of the first array extend along the spirals 1 of the first array so that the centerlines CL1 of the arcuate cleaning element walls 133*a-e* are coincident with the spirals 1. Similarly, the arcuate cleaning element walls 134*a-e* of the second array preferably extend along the spirals 2 of the second array so that the centerlines CL2 of the arcuate cleaning element walls 134*a-e* are coincident with the spirals 2. Of course, in other embodiments, the centerlines of the arcuate cleaning element walls may not be coincident with the spirals.

As can be seen from FIG. 9, the arcuate cleaning element walls 133*a-e*, 134*a-e* of the first and second arrays circumferentially surround the central zone CZ in an alternating manner along the spirals 1, 2. As a result, the concave peripheral surfaces 141 of the arcuate cleaning element walls 133*a* of the first array oppose the convex peripheral surfaces 147 of the arcuate cleaning element walls 134*a* of the second array. Thought of another way, as one travels clockwise about the central zone CZ, all of the arcuate cleaning element walls 133*a-e*, 134*a-e* of the first and second arrays are curved in the same direction.

The first array of spirals 1 forms a first whirl pattern extending from the central zone CZ. The second array of spirals 2 forms a second whirl pattern extending from the central zone CZ.

Finally, when the preferred heights H2, H3, the preferred materials of construction and the alternating manner of the arcuate cleaning element walls 133*a-e*, 134*a-e* of the first and second arrays are implemented, the toothbrush 100 comprises a dual turbine-like arrangement of cleaning elements wherein shorter elastomeric cleaning element walls circumferentially alternate with taller cleaning element walls formed by densely packed bristles. This turbine-like and alternating arrangement provides an effective mechanism in cleaning and polishing the teeth of a user during a brushing session.

The ring wall 136 and/or the arcuate cleaning element walls 133*a-e*, 134*a-e* of the first and second arrays cooperate to help maintain dentifrice in place during brushing. The central zone CZ (which comprises the cavity 137 and central cleaning element 135) provides a central volume to receive the dentifrice. From here, the dentifrice will work/flow outward into the channels 151 (a few of which are delineated in FIG. 6) formed between adjacent arcuate cleaning element walls 133*a-e*, 134*a-e* of the first and second arrays of the dual turbine-like arrangement. However, the arcuate shape of the channels 151 slows the radial escape of the dentifrice, allowing more efficient application to the oral surface during brushing. The mechanism of action discussed above is set forth as a mere explanation of the improved operation of the present invention. It is not to be construed as limiting the scope of the invention.

FIGS. 10-16 illustrate a number of examples of alternative arrangements 138A-G of cleaning element walls for the third set 138 of cleaning element walls according to the present invention. In order to avoid redundancy, a detailed description of these arrangements 138A-G will be omitted with the understanding that the discussion of the concepts above with respect to FIGS. 1-9 are applicable.

Figure 10:
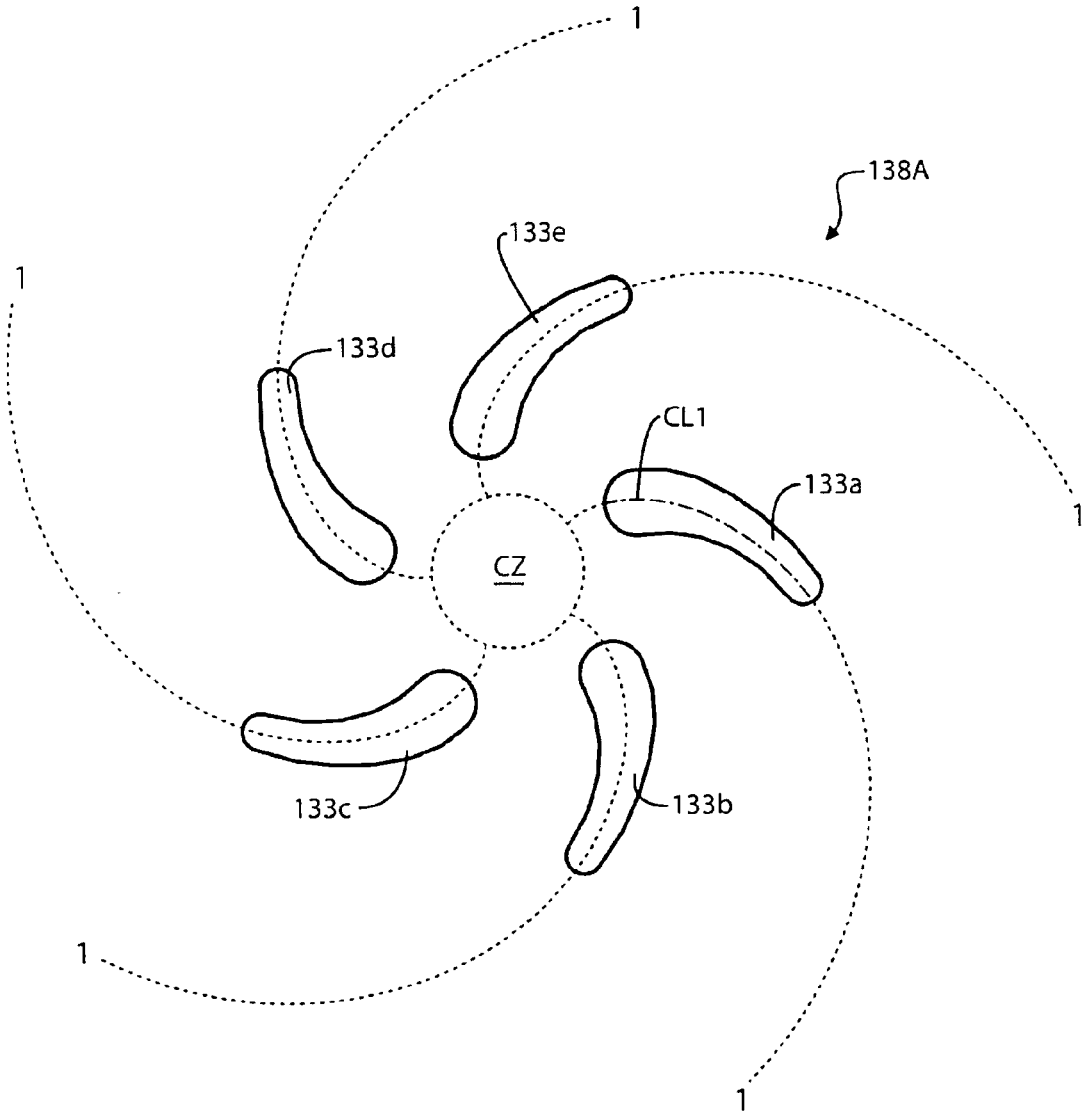
FIG. 10 is a schematic of a first alternative geometric arrangement for arcuate cleaning element walls for a toothbrush according to the present invention.

FIG. 10 discloses an arrangement 138A of cleaning element walls 133*a-e* according to a first alternative of the present invention. Arrangement 138A differs from the third set 138 of cleaning elements discussed above in FIGS. 1-9 in that the arrangement 138A contains only the first array of cleaning element walls 133*a-e* and omits both the central cleaning element 135 and the second array of cleaning element walls 134*a-e*.

Figure 11:
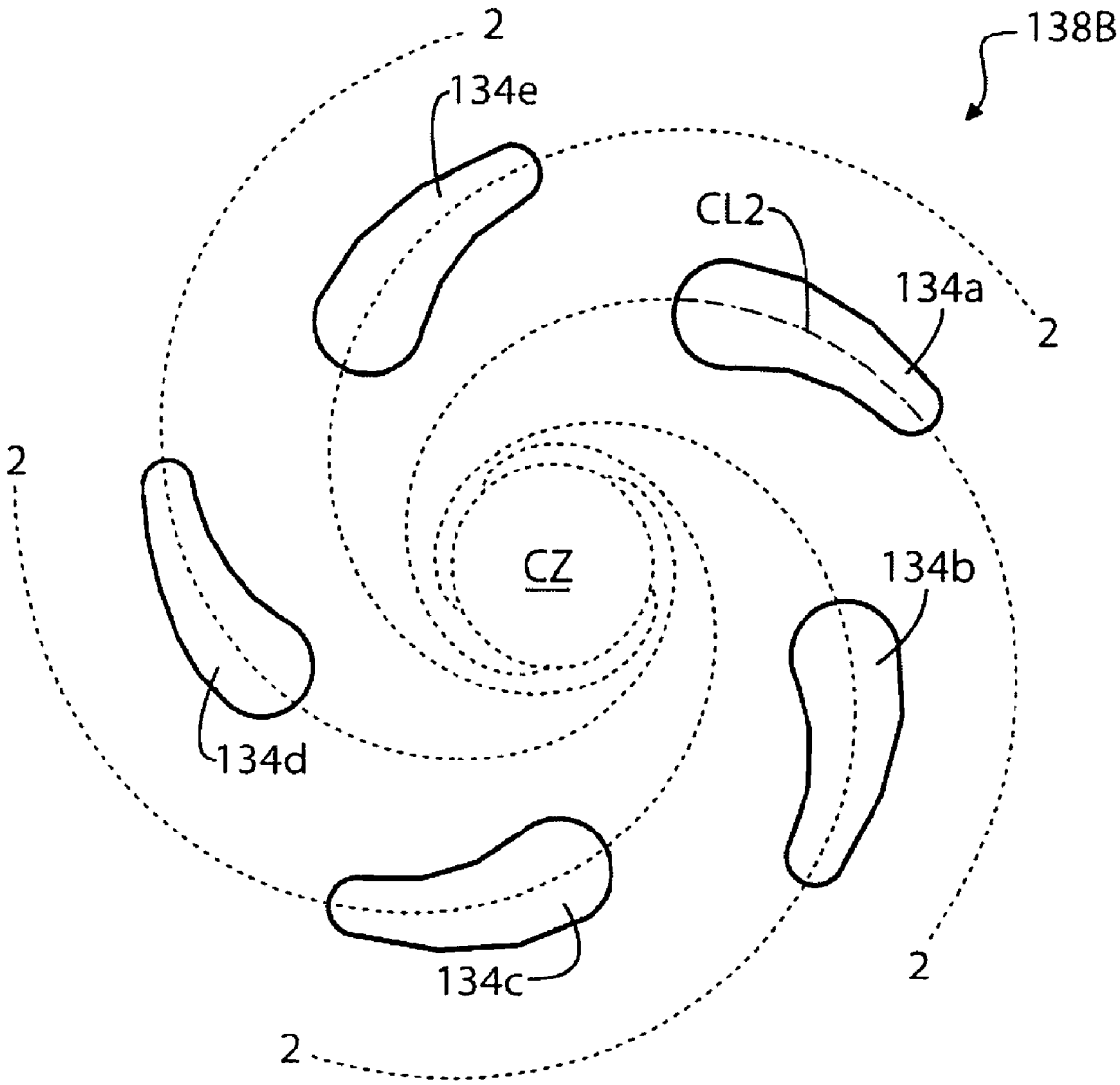
FIG. 11 is a schematic of a second alternative geometric arrangement for arcuate cleaning element walls for a toothbrush according to the present invention.

FIG. 11 discloses an arrangement 138B of cleaning element walls 134*a-e* according to a second alternative of the present invention. Arrangement 138B differs from the third set 138 of cleaning elements discussed above in FIGS. 1-9 in that the arrangement 138B contains only the second array of cleaning element walls 134*a-e* and omits both the central cleaning element 135 and the second array of cleaning element walls 133*a-e*.

Figure 12:
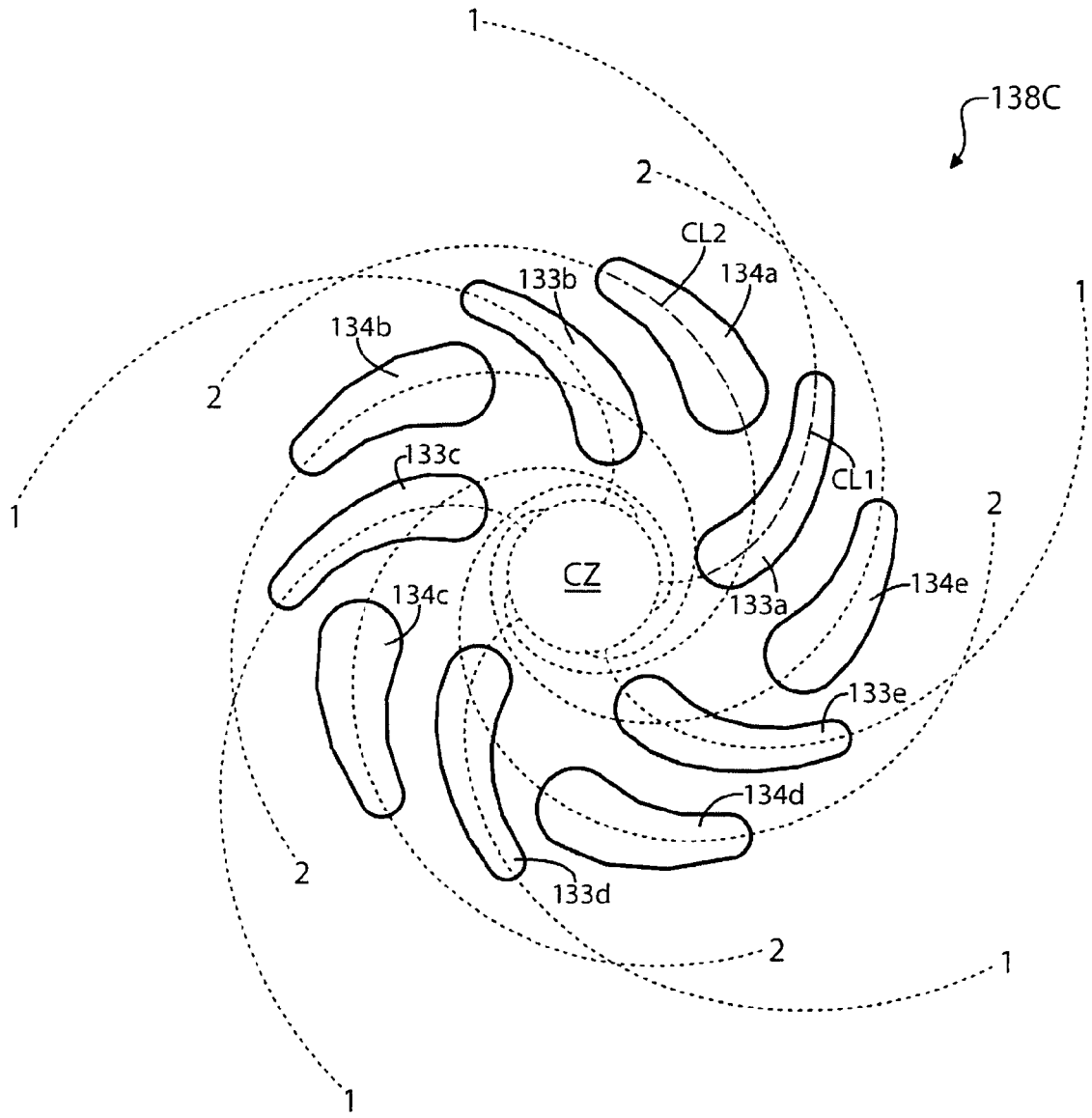
FIG. 12 is a schematic of a third alternative geometric arrangement for arcuate cleaning element walls for a toothbrush according to the present invention.

FIG. 12 discloses an arrangement 138C of cleaning element walls 133*a-e*, 134*a-e* according to a third alternative of the present invention. Arrangement 138C differs from the third set 138 of cleaning elements discussed above in FIGS. 1-9 in that the first and second array of spirals 1, 2 along which the cleaning element walls 133*a-e*, 134*a-e* extend are both counterclockwise spirals.

Figure 13:
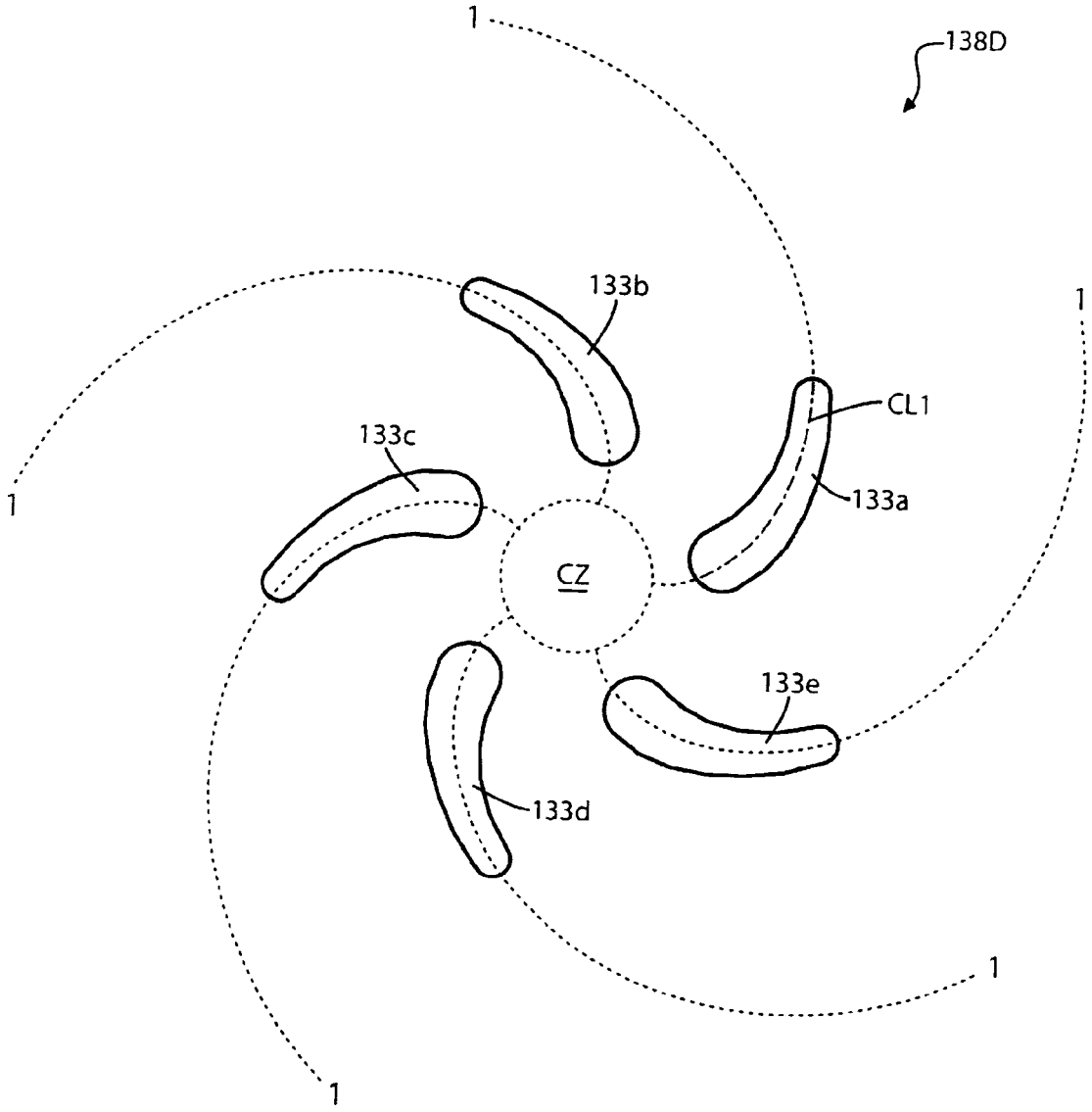
FIG. 13 is a schematic of a fourth alternative geometric arrangement for arcuate cleaning element walls for a toothbrush according to the present invention.

FIG. 13 discloses an arrangement 138D of cleaning element walls 133*a-e* according to a fourth alternative of the present invention. Arrangement 138D differs from the third set 138 of cleaning elements discussed above in FIGS. 1-9 in that the arrangement 138D contains only the first array of cleaning element walls 133*a-e*, omits both the central cleaning element 135 and the second array of cleaning element walls 134*a-e*, and the first array of spirals 1 along which the cleaning element walls 133*a-e*, extend are counterclockwise spirals.

Figure 14:
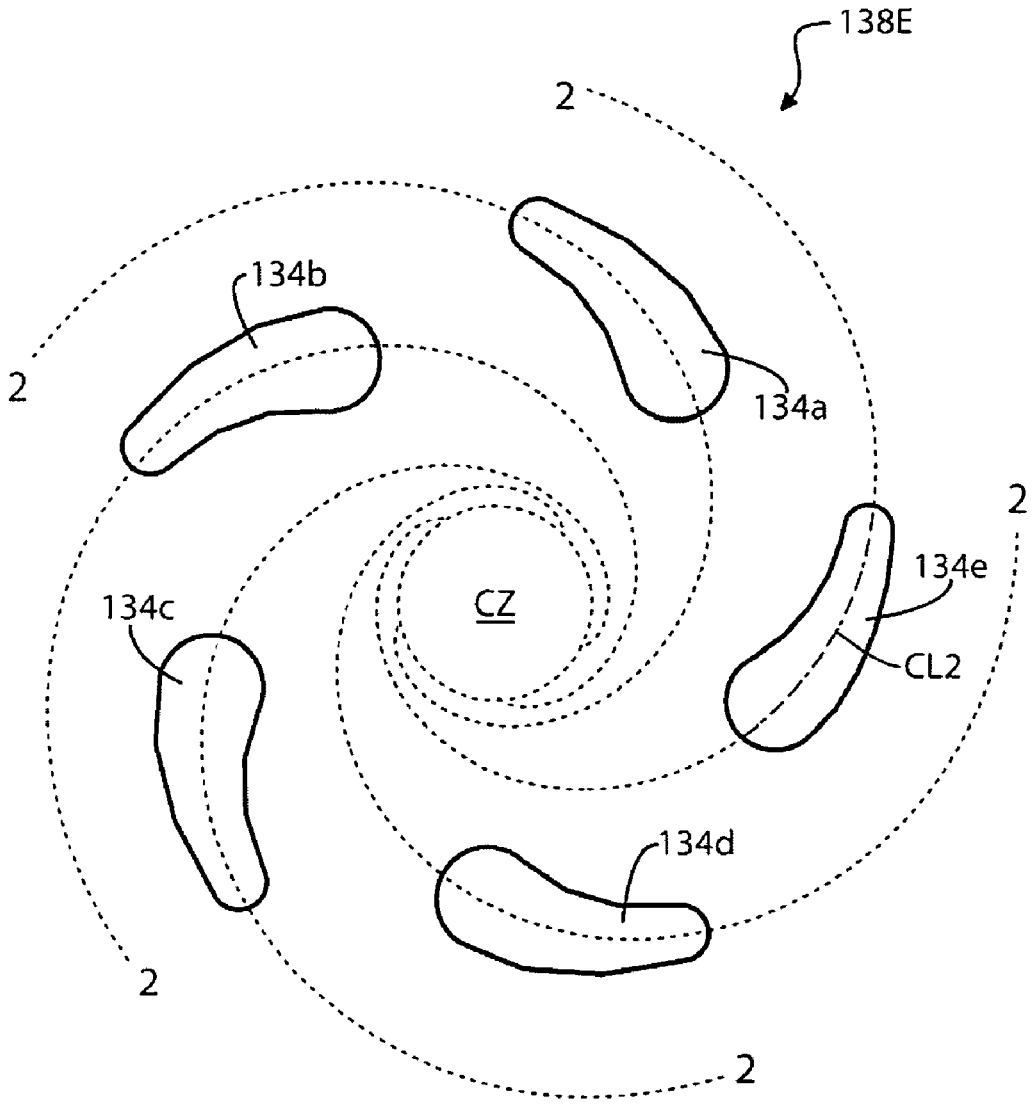
FIG. 14 is a schematic of a fifth alternative geometric arrangement for arcuate cleaning element walls for a toothbrush according to the present invention.

FIG. 14 discloses an arrangement 138E of cleaning element walls 134*a-e* according to a fifth alternative of the present invention. Arrangement 138E differs from the third set 138 of cleaning elements discussed above in FIGS. 1-9 in that the arrangement 138E contains only the second array of cleaning element walls 133*a-e*, omits both the central cleaning element 135 and the first array of cleaning element walls 133*a-e*, and the second array of spirals 2 along which the cleaning element walls 134*a-e*, extend are counterclockwise spirals.

Figure 15:
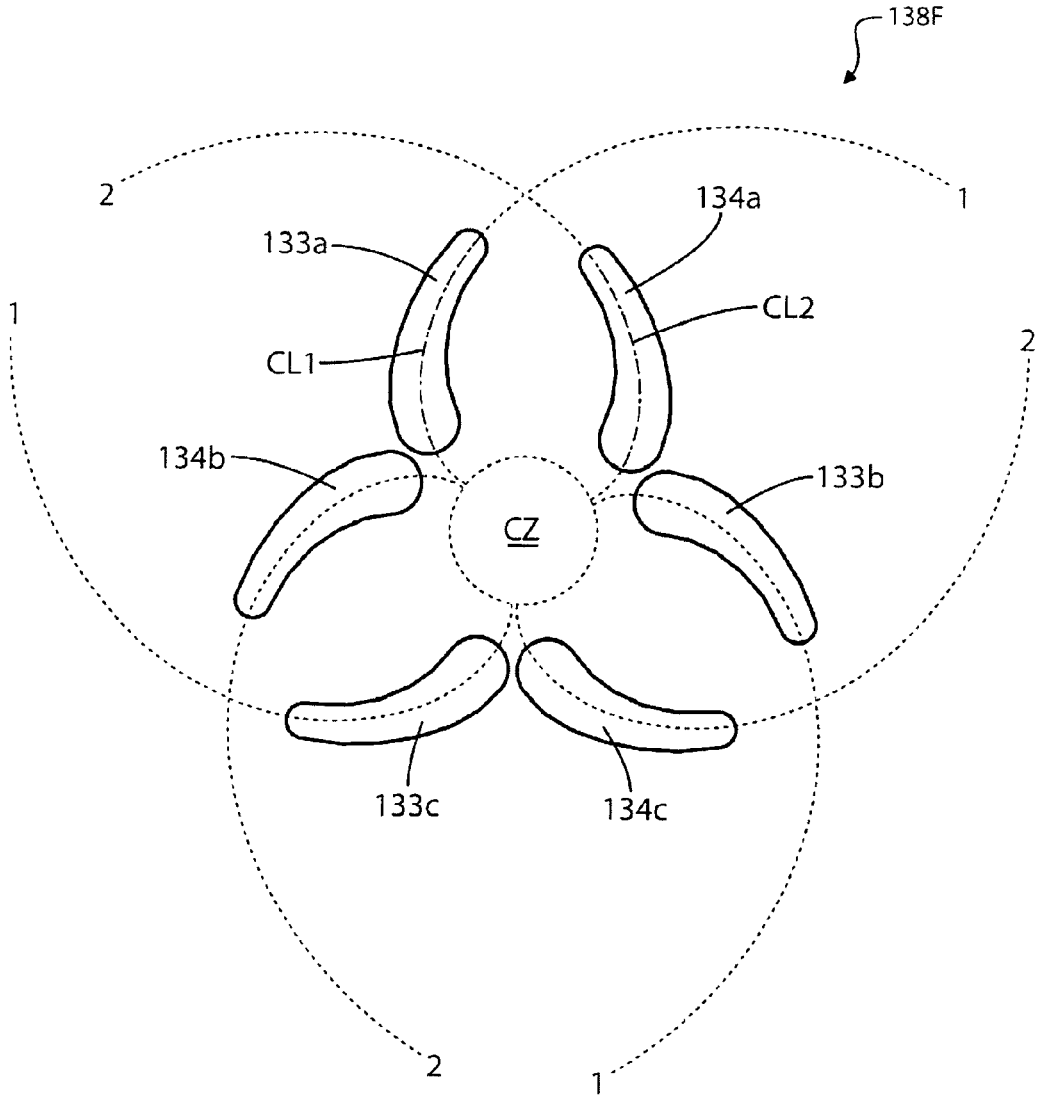
FIG. 15 is a schematic of a sixth alternative geometric arrangement for arcuate cleaning element walls for a toothbrush according to the present invention.

FIG. 15 discloses an arrangement 138F of cleaning element walls 133*a-e*, 134*a-e* according to a sixth alternative of the present invention. Arrangement 138F differs from the third set 138 of cleaning elements discussed above in FIGS. 1-9 in that the arrangement 138F contains only three cleaning element walls 133*a-e*, 134*a-e* for each of the first and second arrays. Also, the second array of spirals 2 along which the cleaning element walls 134*a-e*, extend is a counterclockwise spiral. The first array of spirals 1 along which the cleaning element walls 133*a-e*, extend are clockwise spiral.

Figure 16:
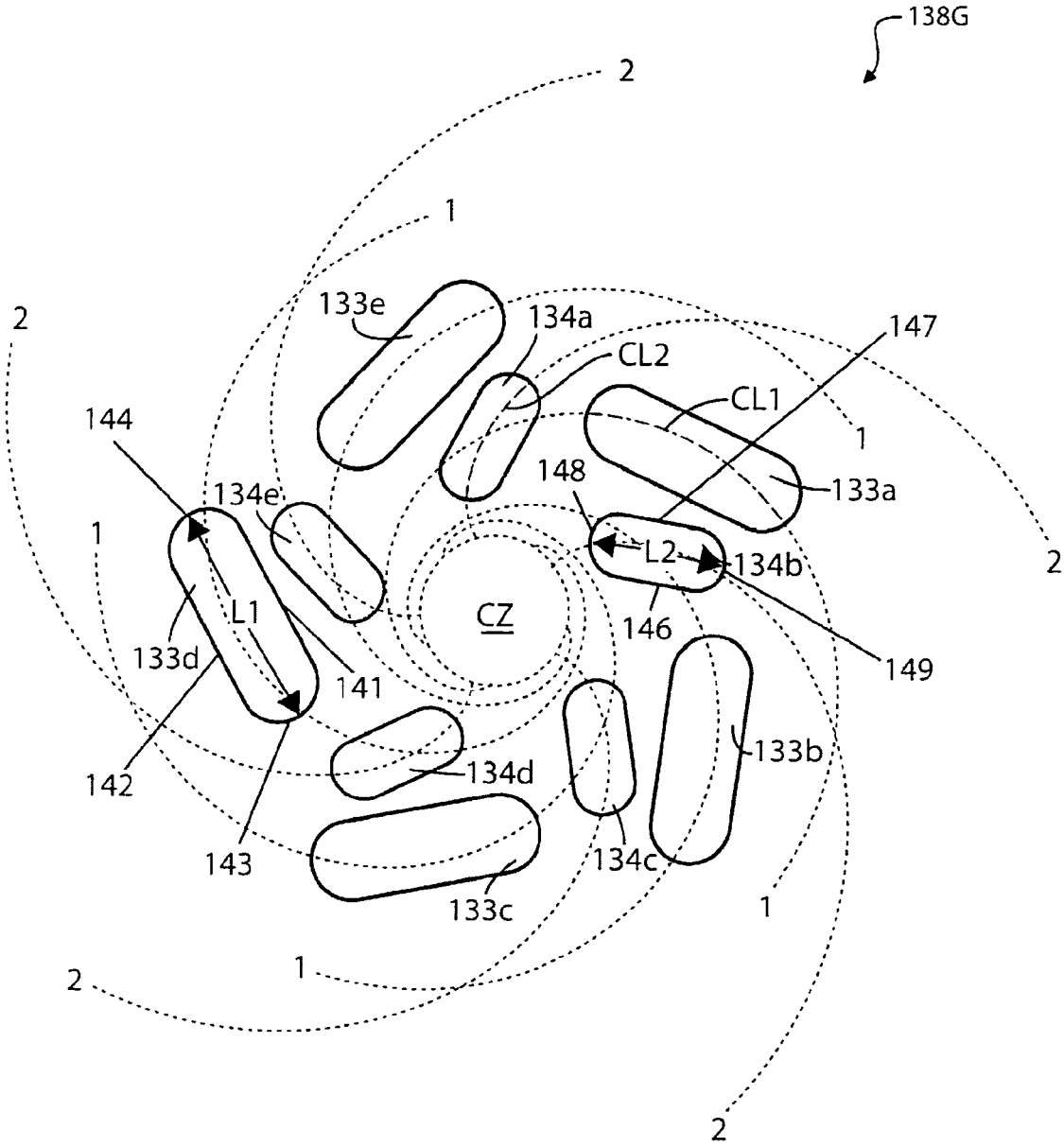
FIG. 16 is a schematic of a seventh alternative geometric arrangement for cleaning element walls for a toothbrush according to the present invention.

FIG. 16 discloses an arrangement 138G of cleaning element walls 133*a-e*, 134*a-e* according to a seventh alternative of the present invention. Arrangement 138G differs from the third set 138 of cleaning elements discussed above in FIGS. 1-9 in that the first and second arrays of the cleaning element walls 133*a-e*, 134*a-e* are non-arcuate. More specifically, the first and second arrays of the cleaning element walls 133*a-e*, 134*a-e* are of an elongated linear shape. The cleaning element walls 133*a-e* of the first array have a planar peripheral side surface 141, a planar peripheral side surface 142, a first peripheral end surface 143 and a second peripheral end surface 144. The first and second peripheral end surfaces 143, 144 define the length L1 of the cleaning element walls 133*a-e* of the first array. Similarly, the cleaning element walls 134*a-e* of the second array have a planar peripheral side surface 146, a planar peripheral side surface 147, a first peripheral end surface 148 and a second peripheral end surface 149. The first and second peripheral end surfaces 148, 149 define the length L2 of the cleaning element walls 134*a-e* of the second array.

The cleaning element walls 133*a-e* of the first array extend outward from the first surface of the head along the spirals 1. More specifically, the cleaning element walls 133*a-e* of the first array are arranged along the spirals 1 so that the spirals 1 extend the length L1 of the cleaning element walls 133*a-e* so as to intersect with both the first and second peripheral end surfaces 143, 144 of each cleaning element wall 133*a-e*. The length L1 is greater than the width of the cleaning element walls 133*a-e*. Similarly, the cleaning element walls 134*a-e* of the second array extend outward from the first surface of the head along the spirals 2. More specifically, the cleaning element walls 134*a-e* of the second array are arranged along the spirals 2 so that the spirals 2 extend the length L2 of the cleaning element walls 134*a-e* so as to intersect with both the first and second peripheral end surfaces 148, 149 of each cleaning element wall 134*a-e*. The length L2 is greater than the width of the cleaning element walls 134*a-e*.

Figure 17:
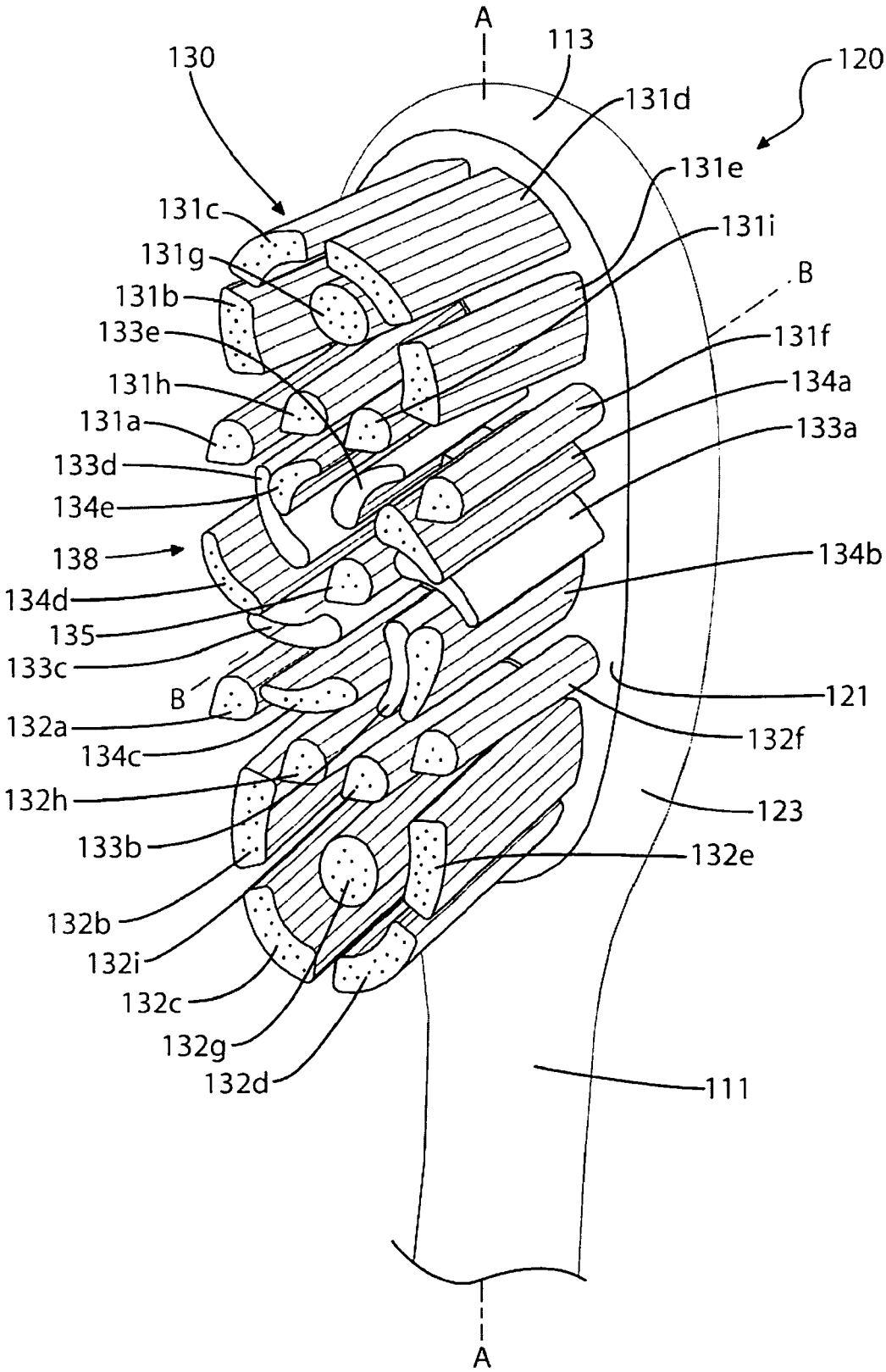
FIG. 17 is a close-up perspective view of a head portion of an ansate oral care implement according to an embodiment of the present invention.
Figure 18:
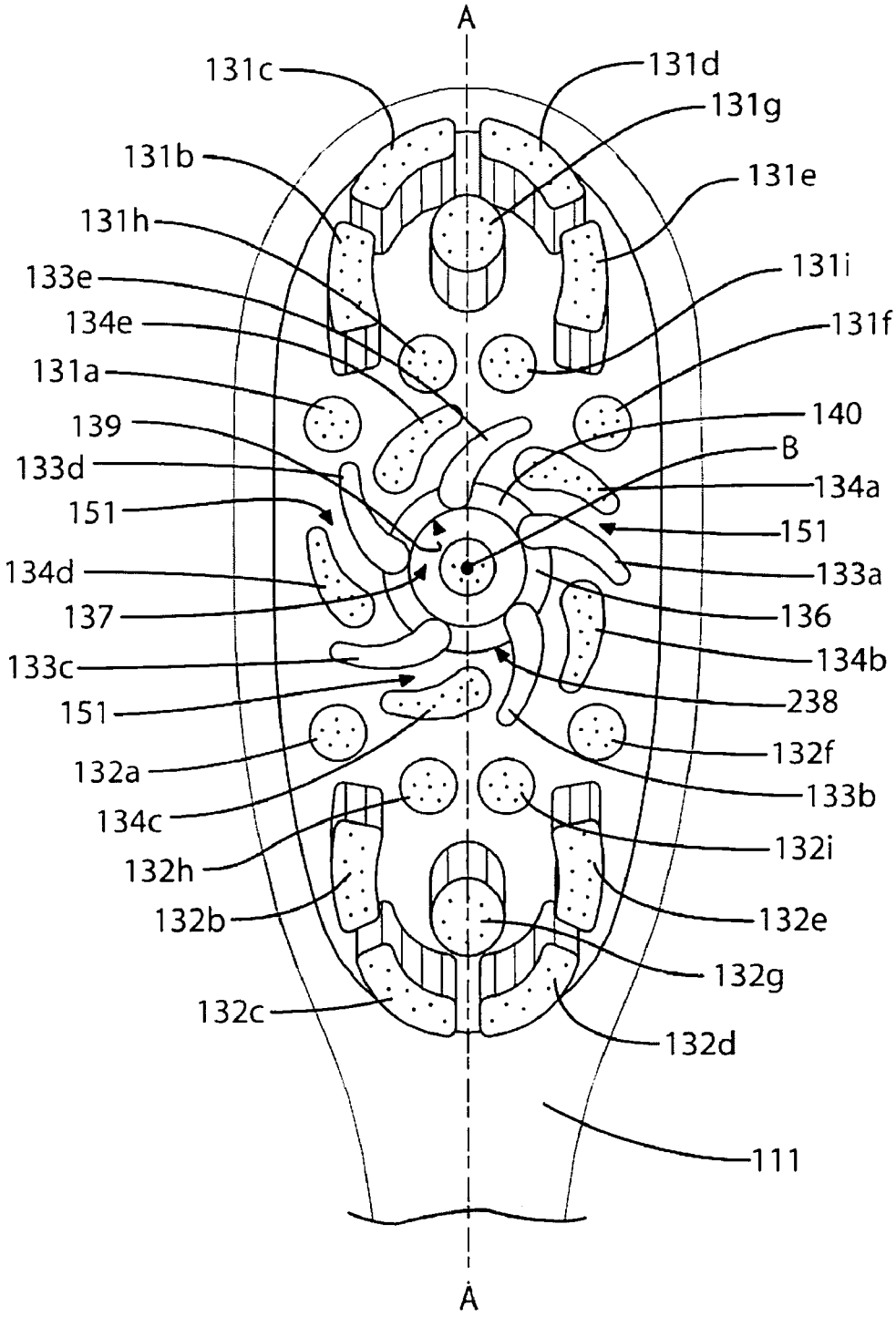
FIG. 18 is a close-up front view of the head portion of FIG. 17.

Referring now to FIGS. 17-18, the toothbrush 100 of FIGS. 1-9 is illustrated having one specific arrangement of cleaning elements for the first and second sets 131, 132 of cleaning elements. The first set 131 comprises cleaning elements 131*a-i* that extend from the distal region 124 of the head 120. The second set 132 comprises cleaning elements 132*a-i* that extend from the proximal region 126 of the head 120.

In the illustrated embodiment, the cleaning elements 131*a-i*, 132*a-i* of the first and second sets are tufts or arcuate walls of densely packed fibrous bristles. However, one or more (or various subsets) of the cleaning elements 131*a-i*, 132*a-i* of the first and second sets can take on other forms, such as elastomeric walls or fingers.

The first set 131 of cleaning elements comprises a first grouping of cleaning elements 131*a*, 131*h*, 131*i*, 131*f* that are located adjacent the central third set 138 of cleaning elements toward the distal end of the head 120. Similarly, the second set 132 of cleaning elements also comprises a first grouping of cleaning elements 132*a*, 132*h*, 132*i*, 132*f* that are located adjacent the central third set 138 of cleaning elements toward the proximal end of the head 120. Each of the cleaning elements 131-132*a*, 131-132*h*, 131-132*i*, 131-132*f* are cylindrical bristle tufts that extend from the top surface 121 of the head 120 in a substantially normal (i.e. upright) orientation and have free ends that terminates in tapered tips. Each of the first groupings of the cleaning elements 131-132*a*, 131-132*h*, 131-132*i*, 131-132*f* are arranged in a generally curved arrangement, respectively about the distal and proximal sides of the central set 138 of cleaning elements.

The first set 131 of cleaning elements also comprises a second grouping of cleaning elements 131*b*, 131*c*, 131*d*, 131*e* located along the distal-most perimeter of the head 120. Each of the cleaning elements 131*b*, 131*c*, 131*d*, 131*e* are in the form of elongated arcuate walls of densely packed bristles.

The second grouping of cleaning elements 131*b*, 131*c*, 131*d*, 131*e* collectively form a larger par-elliptical cleaning element wall at the distal-most end of the head 120 that generally corresponds to the curvature of the perimeter of the distal end of the head 120. Adjacent cleaning elements 131*b*, 131*c*, 131*d*, 131*e* in the second group are separated from each other by a gap. A central cleaning element 131*g* is centrally provided within the par-elliptical cleaning element wall formed by the cleaning elements 131*b*, 131*c*, 131*d*, 131*e*. The central cleaning element 131*g* is cylindrical bristle tuft. Each of the cleaning elements 131*b*, 131*c*, 131*d*, 131*e*, 131*g* extend from the front surface 121 of the head at an inclined orientation (i.e., a non-normal angle) with respect to the front surface 121. More specifically, the cleaning elements 131*b*, 131*c*, 131*d*, 131*e*, 131*g* extend from the front surface 121 of the head 120 at an inclined orientation that angles away from a lateral centerline of the head 120 and toward the distal end of the head 120 (measured from the bases to the free ends of the cleaning elements 131*b*, 131*c*, 131*d*, 131*e*, 132*g*).

Similarly, the second set 132 of cleaning elements also comprises a second grouping of cleaning elements 132*b*, 132*c*, 132*d*, 132*e* located along the proximal-most perimeter of the head 120. Each of the cleaning elements 132*b*, 132*c*, 132*d*, 132*e* are in the form of elongated arcuate walls of densely packed bristles. The second grouping of cleaning elements 132*b*, 132*c*, 132*d*, 132*e* collectively form a larger par-elliptical cleaning element wall at the proximal-most end of the head 120 that generally corresponds to the curvature of the perimeter of the proximal end of the head 120. Adjacent cleaning elements 132*b*, 132*c*, 132*d*, 132*e* in the second group are separated from each other by a gap. A central cleaning element 132*g* is centrally provided within the par-elliptical cleaning element wall formed by the cleaning elements 132*b*, 132*c*, 132*d*, 132*e*. Each of the cleaning elements 132*b*, 132*c*, 132*d*, 132*e*, 132*g* extend from the front surface 121 of the head 120 at an inclined orientation (i.e., a non-normal angle) with respect to the front surface 121. More specifically, the cleaning elements 132*b*, 132*c*, 132*d*, 132*e*, 132*g* extend from the front surface 121 of the head at an inclined orientation that angles away from a lateral centerline of the head 120 and toward the proximal end of the head 120 (measured from the bases to the free ends of the cleaning elements 132*b*, 132*c*, 132*d*, 132*e*, 132*g*).

Figure 19:
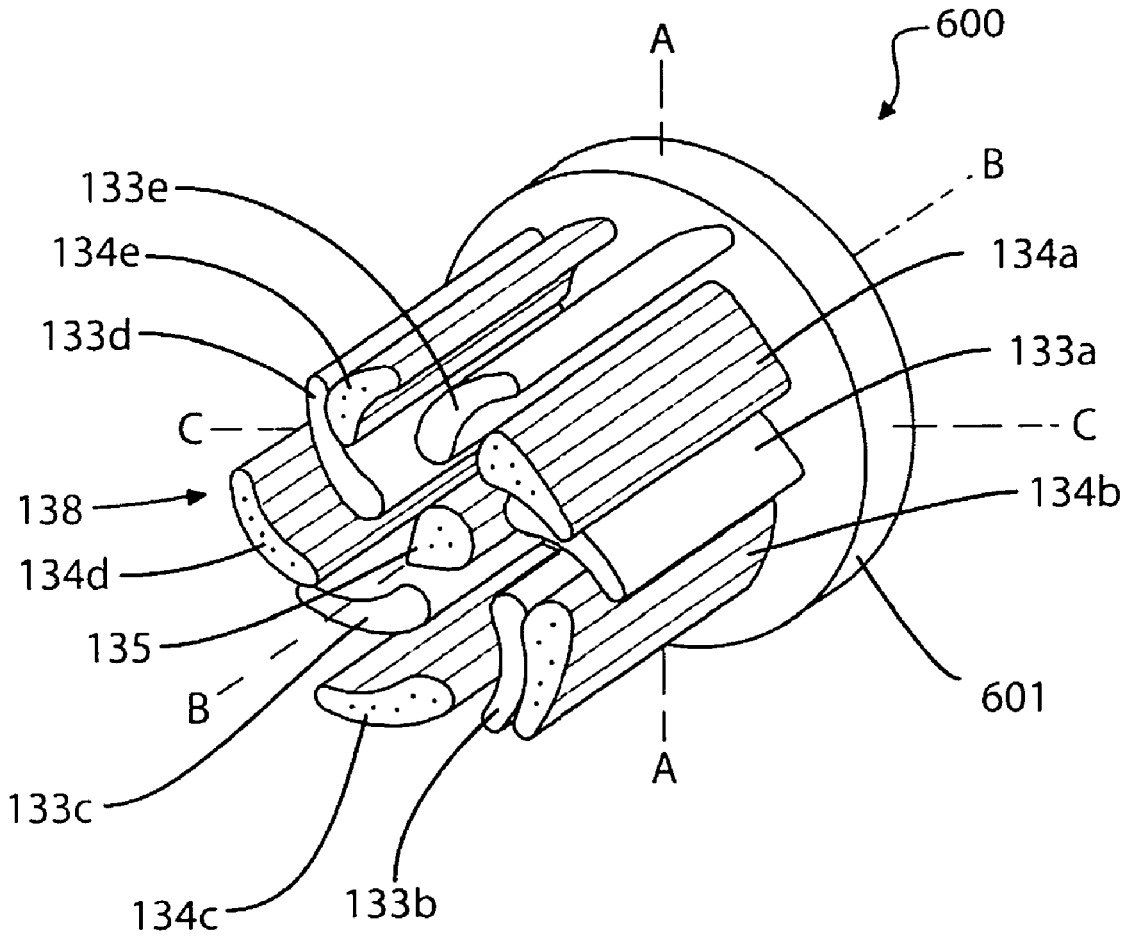
FIG. 19 is a perspective view of a cleaning element disc according to an embodiment of the present invention.

Referring now to FIG. 19, a cleaning element disc 600 for incorporation into an ansate oral care implement is illustrated according to one embodiment of the present invention. The cleaning element disc 600 is essentially a plate-like disc that incorporates the third set 138 of cleaning elements described above with respect to FIGS. 1-9. The apparatus 600 generally comprises a circular base plate 601 and the third set 138 of cleaning elements described above with respect to FIGS. 1-9. In order to avoid redundancy, a further detailed description of the third set 138 of cleaning elements is omitted. However, it is to be understood that the cleaning element disc 600 can utilize any of the variations of the cleaning element arrangement disclosed above with respect to FIGS. 10-16.

The cleaning element disc 600 is particularly suited for use with powered toothbrushes wherein the cleaning element disc 600 will lock into place on the powered toothbrush and be operably coupled to a rotary element. In such an embodiment, the cleaning element disc 600 will preferably be rotated in an oscillating manner during use. The cleaning element disc 600, however, can also be used in manual toothbrushes wherein the cleaning element disc 600 can snap lock/unlock into and out of the head of the toothbrush for replacement. Such techniques are known in the art.

Finally, it should be noted that in certain embodiments of the invention, a plurality of the third sets 138 of cleaning elements can be arranged on the head 120 of the toothbrush 100. In such an embodiment, the third sets 138 of cleaning elements are preferably aligned along the longitudinal axis A-A of the head 120. Moreover, in such an embodiment, any of the arrangements of the third sets 138-138G can be used. Furthermore, the arrangements 138-138G can be mixed and matched as desired.

While a number of embodiments of the current invention have been described and illustrated in detail, various alternatives and modifications will become readily apparent to those skilled in the art without departing from the spirit and scope of the invention. As various changes could be made in the above methods, compositions and structures without departing from the scope of the invention, it is intended that all matter contained in this application, including all mechanisms and/or modes of interaction described above, shall be interpreted as illustrative only and not limiting in any way the scope of the appended claims.

What is claimed is:

1. An oral care implement comprising:

a handle;

a head connected to the handle, the head comprising a first surface, the first surface comprising an elliptical zone and a plurality of circumferentially spaced apart reference spirals spreading out from the elliptical zone;

for each reference spiral, an arcuate cleaning element wall extending outward from the first surface of the head coextensively along the reference spiral;

a ring-like wall extending outward from the first surface of the head, the ring-like wall surrounding the elliptical zone; and wherein the arcuate cleaning element walls are integral with and extend from the ring-like wall.

2. The oral care implement of claim 1 wherein each of the arcuate cleaning element walls have a convex peripheral surface and an opposite concave peripheral surface.

3. The oral care implement of claim 1 further comprising a central cleaning element extending outward from the first surface of the head at a center of the elliptical zone.

4. The oral care implement of claim 1 wherein the arcuate cleaning element walls have a first height and the ring-like wall has a second height, the first height being greater than the second height; and wherein the arcuate cleaning, element walls and the ring-like wall are constructed of an elastomeric material.

5. The oral care implement of claim 1 wherein the arcuate cleaning element walls surround the elliptical zone in a circumferentially symmetric manner.

6. The oral care implement of claim 1 wherein each of the arcuate cleaning element walls are separated from a center point of the elliptical zone by the same radial distance.

7. The oral care implement of claim 1 further comprising:

the head comprising a distal region, a middle region and a proximal region;

wherein the elliptical zone and the arcuate cleaning element walls are located within the middle region of the head;

a first set of cleaning elements extending from the first surface in the proximal region of the head; and a second set of cleaning elements extending from the first surface and located in the distal region of the head.

8. An oral care implement comprising:

a handle;

a head connected to the handle, the head comprising a first surface, the first surface comprising an elliptical zone and a plurality of circumferentially spaced apart reference spirals spreading out from the elliptical zone;

for each reference spiral, an arcuate cleaning element wall extending outward from the first surface of the head coextensively along the reference spiral; and wherein the plurality of circumferentially spaced apart reference spirals comprise a first array of reference spirals and a second array of reference spirals, and wherein the arcuate cleaning element walls located along the reference spirals of the first array are constructed of densely packed bristles and the arcuate cleaning element walls located along the reference spirals of the second array are constructed of an elastomeric material.

9. The oral care implement of claim 8 wherein the reference spirals of the first array are defined by a first set of geometrical characteristics and the reference spirals of the second array are defined by a second set of geometrical characteristics that are different than the first set of geometrical characteristics.

10. The oral care implement of claim 9 wherein the arcuate cleaning element walls of the first and second arrays of reference spirals circumferentially surround the elliptical zone in an alternating manner.

11. The oral care implement of claim 10 wherein the arcuate cleaning element walls located along the reference spirals of the first array have a first height and the arcuate cleaning element walls located along the reference spirals of the second array have a second height that is greater than the first height.

12. An oral care implement comprising:

a handle;

a head connected to the handle, the head comprising a first surface having a first whirl of reference spirals spreading out from a central zone;

for each reference spiral in the first whirl, an arcuate cleaning element wall extending outward from the first surface of the head along the reference spiral;

the first surface having a second whirl of reference spirals spreading out from the central zone;

for each reference spiral in the second whirl, an arcuate cleaning element wall extending outward from the first surface of the head alone the reference spiral of the second whirl;

wherein the arcuate cleaning element walls located along the reference spirals of the first whirl are constructed of densely packed bristles and the arcuate cleaning element walls located along the reference spirals of the second whirl are constructed of an elastomeric material; and wherein the arcuate cleaning element walls of the first and second whirls circumferentially surround the central zone in an alternating manner.

13. The oral care implement of claim 12 wherein the arcuate cleaning element walls located alone the reference spirals of the first whirl have a length, a width and a height, and wherein the width of the arcuate cleaning element walls located along the reference spirals of the first whirl taper with radial distance from the central zone.

14. The oral care implement of claim 13 wherein the arcuate cleaning element walls located along the reference spirals of the second whirl have a length, a width and a height, and wherein the width of the arcuate cleaning element walls located along the reference spirals of the second whirl taper with radial distance from the central zone.

15. An oral care implement comprising:

a handle;

a head connected to the handle, the head comprising a first surface having a first whirl of reference spirals spreading out from a central zone;

for each reference spiral in the first whirl, an arcuate cleaning element wall extending outward from the first surface of the head along the reference spiral;

the first surface having a second whirl of reference spirals spreading out from the central zone;

for each reference spiral in the second whirl, an arcuate cleaning element wall extending outward from the first surface of the head along the reference spiral of the second whirl;

wherein the reference spirals of the first whirl are defined by a first set of geometrical characteristics and the reference spirals of the second whirl are defined by a second set of geometrical characteristics that are different than the first set of geometrical characteristics; and wherein the arcuate cleaning element walls of the first and second whirls circumferentially surround the central zone in an alternating manner.

16. An oral care implement comprising:

a handle;

a head connected to the handle, the head comprising a first surface having a first whirl of references spirals spreading out from a central zone;

for each reference spiral in the first whirl, an arcuate cleaning element wall extending outward from the first surface of the head along the reference spiral;

the first surface having a second whirl of reference spirals spreading out from the central zone;

for each reference spiral in the second whirl, an arcuate cleaning element wall extending outward from the first surface of the head along the reference spiral of the second whirl;

wherein the arcuate cleaning element walls located along the reference spirals of the first whirl have a first height and the arcuate cleaning element walls located along the reference spirals of the second whirl have a second height that is greater than the first height; and wherein the arcuate cleaning element walls of the first and second whirls circumferentially surround the central zone in an alternating manner.

17. An oral care implement comprising:

a handle;

a head connected to the handle, the head comprising a first surface having a central zone;

a first array of arcuate cleaning element wails extending from the first surface, each of the arcuate cleaning element walls in the first array comprising a convex peripheral surface and a concave peripheral surface;

the first array of arcuate cleaning element walls arranged so as to circumferentially surround the central zone in a spaced-apart manner and oriented so that the convex peripheral surface of each cleaning element wall in the first array opposes the concave peripheral wall of an adjacent cleaning element wall in the first array;

a second array of arcuate cleaning element, walls extending from the first surface, each of the arcuate cleaning element walls in the second array comprising a convex peripheral surface and an concave peripheral surface;

the second array of cleaning element walls arranged so as to circumferentially surround the central zone in a spaced-apart manner and oriented so that the convex peripheral surface of each cleaning element wall in the second array opposes the concave peripheral wall of an adjacent cleaning element wall in the first array;

wherein the arcuate cleaning element walls of the first and second arrays are arranged in a circumferentially alternating arrangement; and wherein the arcuate cleaning element walls of the first array are constructed of densely packed bristles and the arcuate cleaning element walls of the second array are constructed of an elastomeric material.

18. The oral care implement of claim 17 wherein the first array of cleaning element walls are arranged along a first whirl of reference spirals spreading out from the central zone.

19. The oral care implement of claim 17 wherein the arcuate cleaning element walls of the first array have a first height and the arcuate cleaning element walls of the second array have a second height that is greater than the first height.

20. An apparatus for an ansate oral implement comprising:

a ring-like wall having an outer surface and an inner surface forming a cavity about a central axis;

an array of arcuate cleaning element walls extending radially outward from the outer surface of the ring-like wall, the array of arcuate cleaning element walls being located about he circumference of the ring-like wall in a spaced-apart manner; and wherein the ring-like wall has a first height and the array of arcuate cleaning element walls have a second height that is greater than the first height.

21. The apparatus of claim 20 wherein the ring-like wall and the array of arcuate cleaning element walls are formed of an elastomeric material.

22. The apparatus of claim 21 wherein the ring-like wall and the array of arcuate cleaning element walls are integrally formed as a unitary structure.

23. The apparatus of claim 20 wherein each of the arcuate cleaning element walls of the array extend outward from the ring-like wall along a reference spiral extending from the ring-like wall.

24. An oral care implement comprising:

a handle;

a head connected to the handle, the head comprising a first surface, the first surface comprising an elliptical zone and a plurality of circumferentially spaced apart reference spirals spreading out from the elliptical zone;

for each reference spiral, an elongated cleaning element wall extending outward from the first surface of the head along the reference spiral; and wherein the purality of circumferentially spaced apart reference spirals comprise a first array of reference spirals and a second array of reference spirals, and wherein the cleaning element walls located along the reference spirals of the first array are constructed of densely packed bristles and the cleaning element walls located alone the reference spirals of the second array are constructed of an elastomeric material.

25. The oral care implement of claim 24 wherein each of the elongated cleaning element walls are arcuate having a convex peripheral surface and an opposite concave peripheral surface, each of the arcuate cleaning element walls extending outward from the first surface of the head coextensively along the reference spiral.

26. The oral care implement of claim 24 wherein the elongated cleaning element walls are substantially linear, each of the linear cleaning element walls having a first end peripheral surface and a second end second peripheral surface that defines a length, and wherein the elongated cleaning element walls extend outward from the first surface of the head along the reference spirals so that the reference spirals intersect both the first and second end peripheral surfaces of each of the elongated cleaning element walls.

27. The oral care implement of claim 24 wherein the reference spirals of the first array are defined by a first set of geometrical characteristics and the reference spirals of the second array are defined by a second set of geometrical characteristics that are different than the first set of geometrical characteristics.

28. The oral care implement of claim 27 wherein the cleaning element walls of the first and second arrays of reference spirals circumferentially surround the elliptical zone in an alternating manner.

29. The oral care implement of claim 28 wherein the cleaning element walls located along the reference spirals of the first array have a first height and the cleaning element walls located along the reference spirals of the second array have a second height that is greater than the first height.

30. The oral care implement of claim 24 wherein each of the cleaning element walls are separated from a center point of the elliptical zone by the same radial distance.

* * * * *